US009341181B2

(12) United States Patent
Sakamoto

(10) Patent No.: US 9,341,181 B2
(45) Date of Patent: May 17, 2016

(54) CONTROL DEVICE OF HIGH PRESSURE PUMP

(71) Applicant: DENSO CORPORATION, Kariya, Aichi-pref. (JP)

(72) Inventor: Yuuki Sakamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 395 days.

(21) Appl. No.: 13/837,238

(22) Filed: Mar. 15, 2013

(65) Prior Publication Data

US 2013/0243608 A1 Sep. 19, 2013

(30) Foreign Application Priority Data

Mar. 16, 2012 (JP) ..... 2012-59680
Mar. 19, 2012 (JP) ..... 2012-61539

(51) Int. Cl.
*F04B 49/20* (2006.01)
*F04B 53/10* (2006.01)
*F02D 41/24* (2006.01)
(Continued)

(52) U.S. Cl.
CPC ..... *F04B 53/1082* (2013.01); *F02D 41/20* (2013.01); *F02D 41/2464* (2013.01); *F04B 49/22* (2013.01); *F02D 2041/2037* (2013.01)

(58) Field of Classification Search
CPC . F04D 41/20; F04D 41/2464; F04D 41/3845; F04D 2041/2037; F04B 49/22; F04B 53/1082
USPC ..... 417/26; 123/499, 511
See application file for complete search history.

(56) References Cited

U.S. PATENT DOCUMENTS

2009/0301439 A1 12/2009 Suzuki et al.
2010/0237266 A1 9/2010 Haaf et al.
2011/0265765 A1 11/2011 Furuhashi et al.

FOREIGN PATENT DOCUMENTS

JP 4-153542 5/1992
JP 05062826 A * 3/1993
JP 7-208247 8/1995
(Continued)

OTHER PUBLICATIONS

Office Action (3 pages) dated Jan. 6, 2015, issued in corresponding Japanese Application No. 2012-059680 and English translation (3 pages).
(Continued)

*Primary Examiner* — Patrick Hamo
(74) *Attorney, Agent, or Firm* — Nixon & Vanderhye PC

(57) ABSTRACT

When a flow regulating valve is opened, the passage of current through a solenoid is stopped to move a movable part from a closing-side position to an opening-side position and to thereby open the flow regulating valve. When a sound reducing control performing condition is fulfilled, a valve-opening control for reducing sound is performed. In the valve-opening control, until a fuel pressure in a pump chamber is decreased and the flow regulating valve is opened, the passage of current through the solenoid is continuously performed to hold the movable part at the closing-side position. After the flow regulating valve is opened, the passage of current through the solenoid is stopped. Before the movable part reaches the opening-side position, the passage of current is again temporarily performed. An electromagnetic attracting force is temporarily generated and a moving speed of movable part is decreased by the attracting force.

7 Claims, 21 Drawing Sheets

(51) Int. Cl.
*F04B 49/22* (2006.01)
*F02D 41/20* (2006.01)

(56) References Cited

FOREIGN PATENT DOCUMENTS

| | | |
|---|---|---|
| JP | 11-030147 | 2/1999 |
| JP | 2001-182593 | 7/2001 |
| JP | 2003-161226 | 6/2003 |
| WO | WO 2006/060545 | 6/2006 |

OTHER PUBLICATIONS

Office Action (1 page) dated Jun. 27, 2014, issued in corresponding Japanese Application No. 2012-061539 and English translation (2 pages).
Office Action (2 pages) dated Jun. 20, 2014, issued in corresponding Japanese Application No. 2012-059680 and English translation (2 pages).

* cited by examiner

CONTROL DEVICE OF HIGH PRESSURE PUMP

CROSS-REFERENCE TO RELATED APPLICATION

This application is based on Japanese Patent Applications No. 2012-59680 filed on Mar. 16, 2012 and No. 2012-61539 filed on Mar. 19, 2012, the disclosures of which are incorporated herein by reference.

TECHNICAL FIELD

The present disclosure relates to a control device of a high pressure pump provided with an electromagnetic actuator for opening and closing an intake port side of the high pressure pump.

BACKGROUND

A direct injection type engine of directly injecting fuel into a cylinder is shorter in the time that elapses from when the fuel is injected until the fuel is combusted than an intake port injection type engine of injecting fuel into an intake port and hence cannot sufficiently earn the time required to vapor the fuel injected. Hence, the direct injection type engine needs to increase an injection pressure to a high pressure to thereby atomize the fuel injected. For this reason, in the direct injection type engine, the fuel suctioned from a fuel tank by a low pressure pump of an electrically driven type is supplied to a high pressure pump driven by the power of the engine and the high-pressure fuel discharged from the high pressure pump is pressure-fed to a fuel injection valve.

The high pressure pump of this type includes, for example, a pump described in JP-2010-533820A (US-2010-0237266A1) which is provided with a flow regulating valve for opening and closing an intake port side of the high pressure pump and with an electromagnetic actuator for moving the flow regulating valve to open and close the flow regulating valve and which controls the passage of current through the electromagnetic actuator to thereby control a period during which the flow regulating valve is closed, thereby controlling an amount of discharge of the fuel of the high pressure pump to control a fuel pressure (pressure of the fuel).

Further, as a technique for reducing noises caused when a fuel injection valve constructed of an electromagnetic valve is closed is proposed, for example, a technique disclosed in JP-4-153542A. In this technique, when the passage of current through a drive coil of a fuel injection valve (electromagnetic valve) is stopped to thereby close the fuel injection valve, the passage of current through the drive coil is stopped and then is again temporarily performed, whereby a valve closing speed of the fuel injection valve is decreased.

In the high pressure pump described above, when a valve-closing control of stopping the passage of current through the solenoid of the electromagnetic actuator to thereby move a movable part of the electromagnetic actuator to an opening-side position and to thereby open the flow regulating valve is performed, the movable part and the flow regulating valve are likely collide with a stopper or the like to cause vibrations and hence is likely to cause unpleasant noises by the vibrations.

As shown in FIG. 4, when the valve-opening control of a high pressure pump is performed, even if the passage of current through the solenoid is stopped, when fuel pressure in the pump chamber is yet high, even if the movable part hits the flow regulating valve, the flow regulating valve is held in a valve closing state by the fuel pressure in the pump chamber and hence the movable part is stopped in a state where the movable part abuts on the flow regulating valve. Then, when the fuel pressure in the pump chamber is decreased, the movable part is moved to the opening-side position and the flow regulating valve is opened.

For this reason, when the valve-opening control of the high pressure pump is performed, even if the passage of current through the solenoid is stopped at the same timing as a normal valve-closing control and then is again temporarily performed by the use of the technique disclosed in JP-4-153542A, as shown in FIG. 6, the passage of current through the solenoid is likely to be performed when the movable part hits the flow regulating valve and stops there. In this case, when the fuel pressure in the pump chamber is thereafter decreased to thereby move the movable part to the opening-side position, the moving speed cannot be decreased, which hence makes it difficult to reduce noises caused when the valve-opening control is performed.

When the valve-closing control of the flow regulating valve is performed, the movable part is likely to collide with a stopper part to thereby cause vibrations and hence unpleasant noises are likely to be caused by the vibrations. As a measure against this problem, in JP-2010-533820 (US-2010-0237266A1), is proposed the following technique: that is, a current value when current is passed through the flow regulating valve to thereby close the flow regulating valve is made a minimum current value, whereby a valve closing speed is decreased to thereby prevent the vibrations caused when the valve-closing control is performed.

However, the minimum current value capable of closing an electromagnetic valve is varied according to variations in manufacture and a usage environment (drive voltage and temperature), so that it is difficult to set a value of current passed through the electromagnetic valve at the minimum current value capable of closing the valve with high accuracy and hence a faulty valve closing operation incapable of closing the electromagnetic valve because of a shortage of current is likely to caused. Further, in order to secure a robust performance, a countermeasure such as a correction using the fuel pressure is required.

Hence, it is necessary to reduce noises caused when a valve-closing control is performed and to restrict a valve closing operation caused by a shortage of current.

Further, it is necessary to reduce noises caused when a valve-opening control of a high pressure pump is performed.

SUMMARY

According to the present disclosure, a control device of a high pressure pump is provided with a pump chamber having an intake port and a discharge port of fuel, a plunger reciprocating in the pump chamber, and a flow regulating valve of opening and closing the intake port side, and an electromagnetic actuator for moving the flow regulating valve to thereby open and close the flow regulating valve.

Further, the control device of a high pressure pump is provided with a valve-opening control portion for stopping passing current through a solenoid of the electromagnetic actuator to thereby perform a valve-opening control of moving a movable part of the electromagnetic actuator from a closing-side position to an opening-side position and opening the flow regulating valve. When the valve-opening control portion performs the valve-opening control, the valve-opening control portion continuously passes the current through the solenoid to thereby hold the movable part at the closing-side position until a fuel pressure in the pump chamber is decreased and the flow regulating valve is opened, and after the flow regulating valve is opened, the valve-opening control portion once stops passing the current through the solenoid and again temporarily passes the current through the solenoid before the movable part reaches the opening-side position.

In this construction, when the control device of a high pressure pump performs the valve-opening control, the control device of a high pressure pump continuously passes the current through the solenoid to thereby hold the movable part at the closing-side position until the fuel pressure in the pump chamber is decreased and the flow regulating valve is opened, and after the flow regulating valve is opened, the control device of a high pressure pump once stops passing the current through the solenoid, whereby the movable part does not hit the flow regulating valve and stop there but moves to the opening-side position. Then, the control device of a high pressure pump again temporarily passes the current through the solenoid before the movable part reaches the opening-side position, which hence can temporarily generate an electromagnetic attracting force of the solenoid and can decrease the moving speed when the movable part moves to the opening-side position by the electromagnetic attracting force. In this way, the control device of a high pressure pump can prevent vibrations caused when the movable part reaches the opening-side position and hence can reduce noises caused when the control device of a high pressure pump performs the valve-opening control.

In addition, a control device of a high pressure pump, which is provided with a pump chamber, a plunger reciprocating in the pump chamber, and a flow regulating valve of opening and closing an intake port side, and an electromagnetic actuator for moving the flow regulating valve to thereby open and close the flow regulating valve, is provided with a valve-closing control portion for passing a drive current through a solenoid of the electromagnetic actuator to thereby move a movable part of the electromagnetic actuator from an opening-side position to a closing-side position and to thereby close the flow regulating valve. When a given performing condition is fulfilled, the valve-closing control portion performs a slow valve-closing control of decreasing a rate of rise of the drive current of the solenoid more than in a normal valve-closing control and making the drive current of the solenoid reach a current value equal to a current value when the valve-closing control portion performs the normal valve-closing control.

In this construction, when the control device of a high pressure pump performs the valve-closing control (in other words, when the control device of a high pressure pump passes the drive current through the solenoid of the electromagnetic actuator to thereby move the movable part from the opening-side position to the closing-side position, thereby closing the flow regulating valve), if the given performing condition is fulfilled, the control device of a high pressure pump performs the slow valve-closing control of decreasing the rate of rise (rising speed) of the drive current of the solenoid more than in the normal valve-closing control and hence can slowly increase an electromagnetic attracting force of the solenoid to thereby decrease the moving speed of the movable part. In this way, the control device of a high pressure pump can prevent vibrations caused when the movable part collides with a stopper part and hence can reduce noises caused when the control device of a high pressure pump performs the valve-closing control.

In addition, the control device of a high pressure pump only decreases the rate of rise of the drive current of the solenoid more than in the normal valve-closing control, so that finally the control device of a high pressure pump can increase the drive current of the solenoid to the same current value as in the normal valve-closing control. In this way, even if a minimum current value necessary for closing the flow regulating valve is varied by variations in manufacture and by a usage environment (drive voltage and temperature), the control device of a high pressure pump can avoid a shortage of current, which hence can prevent a faulty valve closing operation from being caused by the shortage of current and also can eliminate the need of making a correction using the fuel pressure or the like.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

[First Embodiment]

Figure 1:
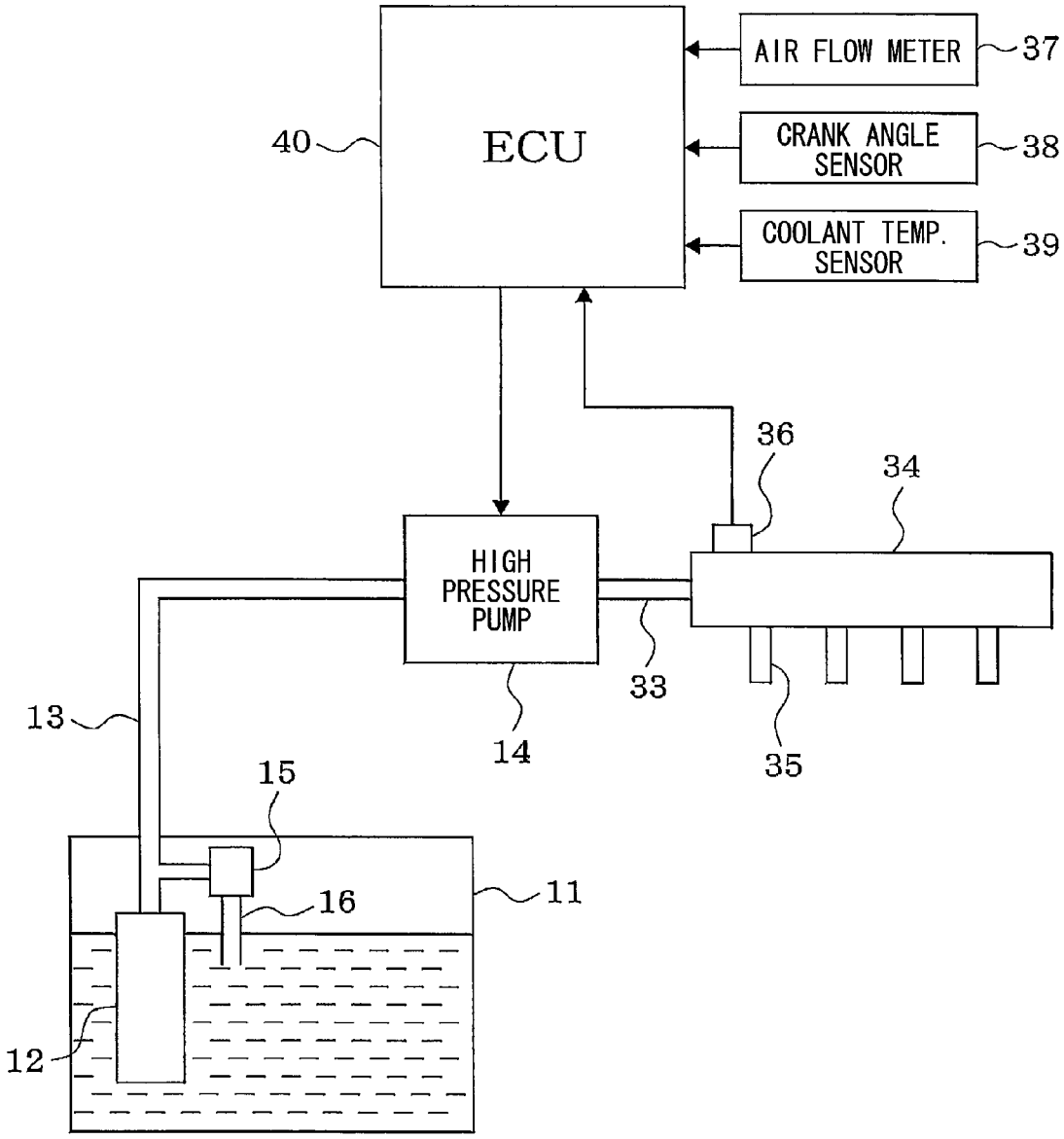
FIG. 1 is a diagram to show a general construction of a fuel supply system of a direct injection type engine in one embodiment of the present disclosure.

Hereinafter, one embodiment will be described in which a mode for carrying out the present disclosure is embodied.

A low pressure pump 12 for sucking up fuel is set in a fuel tank 11 for storing the fuel. This low pressure pump 12 is driven by an electric motor (not shown) having a battery (not shown) as a power source. The fuel discharged from the low pressure pump 12 is passed through a fuel pipe 13 and is supplied to a high pressure pump 14. The fuel pipe 13 has a pressure regulator 15 connected thereto and the discharge pressure of the low pressure pump 12 (pressure of the fuel to be supplied to the high pressure pump 14) is regulated to a specified pressure by the pressure regulator 15. An excess amount of fuel higher than the specified pressure is returned into the fuel tank 11 through a fuel return pipe 16.

Figure 2:
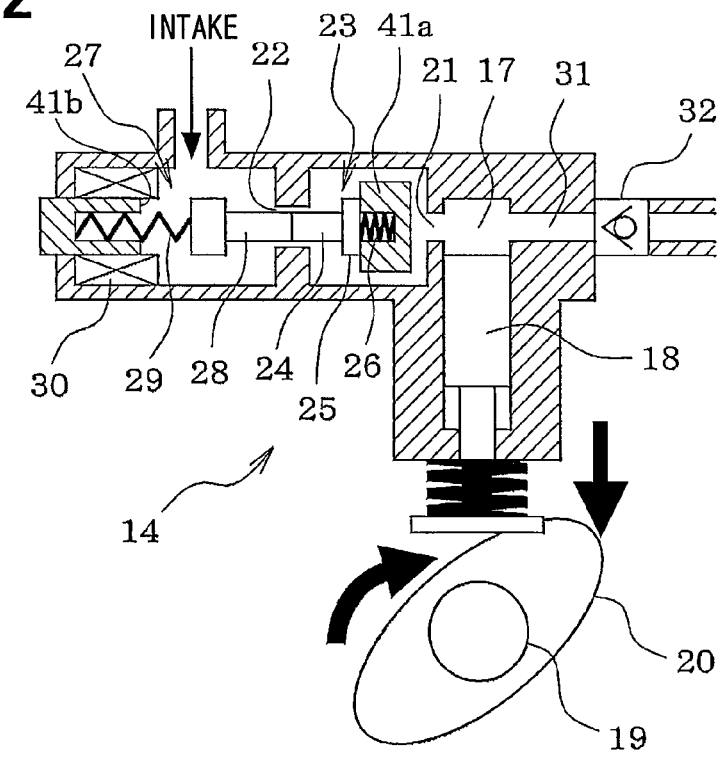
FIG. 2 is a schematic construction view to show a state when a high pressure pump sucks fuel.
Figure 3:
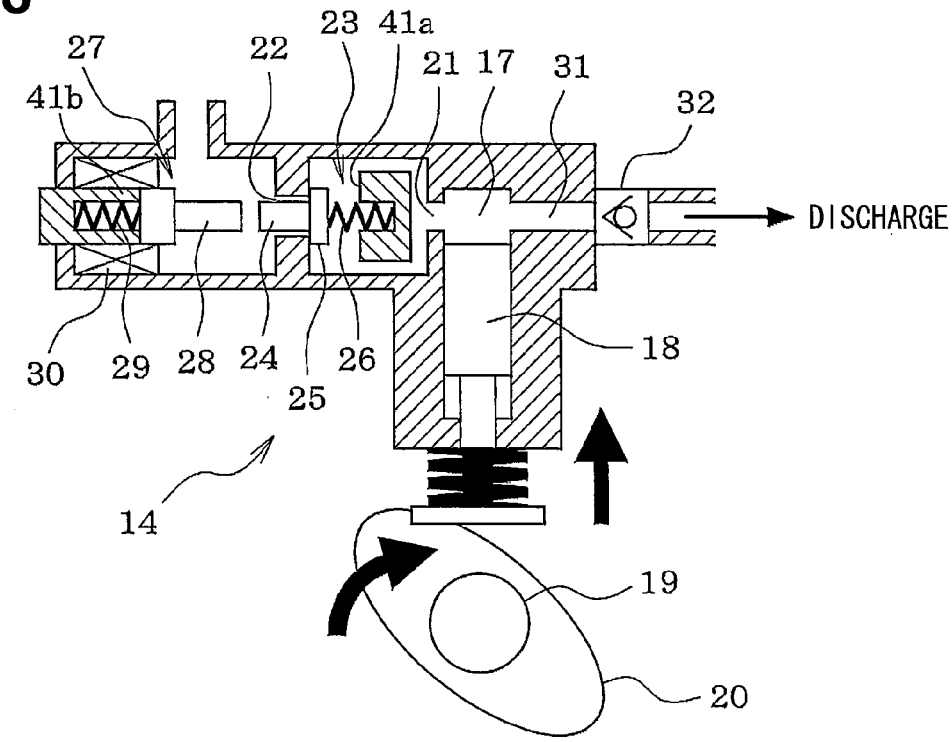
FIG. 3 is a schematic construction view to show a state when the high pressure pump discharges the fuel.

As shown in FIG. 2 and FIG. 3, the high pressure pump 14 is a plunger pump of reciprocating a plunger 18 in a cylindrical pump chamber 17 to suck and discharge the fuel, and the plunger 18 is driven by a rotational motion of a cam 20 fitted on a camshaft 19 of an engine. On an intake port 21 side of the high pressure pump 14 are disposed a flow regulating valve 23 for opening and closing a fuel passage 22 and an electromagnetic actuator 27 for moving the flow regulating valve 23.

The electromagnetic actuator 27 is constructed of a movable part 28 that can move, a spring 29 for biasing the movable part 28 to an opening-side position (see FIG. 2), and a solenoid 30 (coil) for electromagnetically driving the movable part 28 to a closing-side position (see FIG. 3). The flow regulating valve 23 is constructed of a pressing portion 24 pressed in a valve opening direction by the movable part 28 of the electromagnetic actuator 27, a valve body 25 for opening and closing the fuel passage 22, and a spring 26 for biasing the valve body 25 in a valve closing direction. Further, on the discharge port 31 side of the high pressure pump 14 is disposed a check valve 32 for preventing the discharged fuel from flowing back.

As shown in FIG. 2, when the electromagnetic actuator 27 is not electrically energized (when the passage of current through the solenoid 30 is off), the movable part 28 is moved to the opening-side position by a biasing force of the spring 29 of the electromagnetic actuator 27, so that the pressing portion 24 of the flow regulating valve 23 is pressed by the movable part 28 and hence the valve body 25 is moved in the valve opening direction, whereby the flow regulating valve 23 is opened and hence the fuel passage 22 is opened.

On the other hand, as shown in FIG. 3, when the electromagnetic actuator 27 is electrically energized (when the passage of current through the solenoid 30 is on), the movable part 28 is moved to the closing-side position by an electromagnetic attracting force of the solenoid 30 of the electromagnetic actuator 27, so that the valve body 25 is moved in the valve closing direction by the biasing force of the spring 26 of the flow regulating valve 23, whereby the flow regulating valve 23 is closed and hence the fuel passage 22 is closed.

The passage of current through the electromagnetic actuator 27 (the solenoid 30) is controlled in such a way that the valve body 25 of the flow regulating valve 23 is opened in an intake stroke of the high pressure pump 14 (when the plunger 18 is moved down), as shown in FIG. 2, whereby the fuel suctioned into the pump chamber 17 and that the valve body 25 of the flow regulating valve 23 is closed in a discharge stroke of the high pressure pump 14 (when the plunger 18 is moved up), as shown in FIG. 3, whereby the fuel in the pump chamber 17 is discharged.

At that time, the timing of starting to pass the current through the electromagnetic actuator 27 (the solenoid 30) is controlled to thereby control a period during which the flow regulating valve 23 is closed, which in turn controls the amount of discharge of the fuel of the high pressure pump 14 to thereby control a fuel pressure (pressure of the fuel). For example, at the time of increasing the fuel pressure, the timing of starting to pass the current through the electromagnetic actuator 27 is advanced to thereby advance the timing of starting to close the flow regulating valve 23, whereby a period during which the flow regulating valve 23 is closed is elongated to thereby increase a discharge flow rate of the high pressure pump 14. On the other hand, at the time of decreasing the fuel pressure, the timing of starting to pass the current through the electromagnetic actuator 27 is delayed to thereby delay the timing of starting to close the flow regulating valve 23, whereby a period during which the flow regulating valve 23 is closed is shortened to thereby decrease the discharge flow rate of the high pressure pump 14.

As shown in FIG. 1, the fuel discharged from the high pressure pump 14 is fed to a delivery pipe 34 through a high pressure pipe 33, and the high pressure fuel is distributed to fuel injection valves 35 fixed to respective cylinders of the engine from the delivery pipe 34. The delivery pipe 34 (or high pressure fuel pipe 33) is provided with a fuel pressure sensor 36 for detecting a fuel pressure in a high pressure fuel passage of the high pressure fuel pipe 33 and the delivery pipe 34.

Further, the engine is provided with an air flow meter 37 for detecting an amount of intake air and with a crank angle sensor 38 for outputting a pulse signal at intervals of a given crank angle in synchronization with the rotation of a crankshaft (not shown). A crank angle and an engine rotation speed are detected on the basis of the output signal of the crank angle sensor 38. In addition, a cylinder block of the engine is provided with a coolant temperature sensor 39 for detecting a coolant temperature (temperature of coolant).

The outputs of these various sensors are inputted to an electronic control unit (hereinafter referred to as "ECU") 40. The ECU 40 is constructed mainly of a microcomputer and executes various programs stored in a built-in ROM (memory medium) and for controlling the engine to thereby control an amount of fuel injected, an ignition timing, and a throttle opening (amount of intake air).

Figure 4:
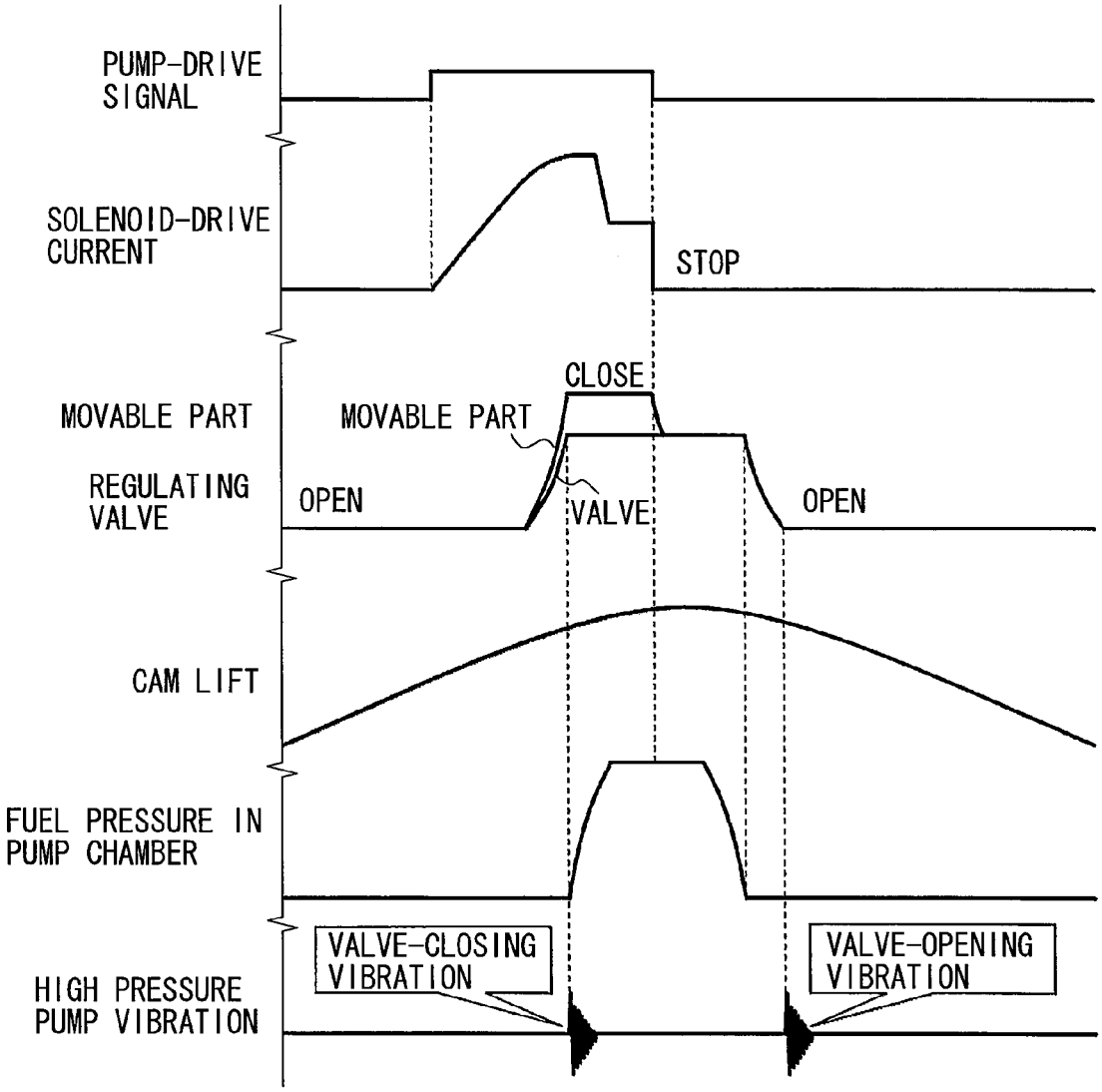
FIG. 4 is a chart to illustrate a normal valve-opening control.

Further, as shown in FIG. 4, when the ECU 40 performs a valve-closing control of closing the flow regulating valve 23 of the high pressure pump 14, the ECU 40 passes current through the solenoid 30 of the electromagnetic actuator 27 to thereby move the movable part 28 of the electromagnetic actuator 27 from the opening-side position to the closing-side position, thereby closing the flow regulating valve 23. Then, when the ECU 40 performs a valve-opening control of opening the flow regulating valve 23 of the high pressure pump 14, the ECU 40 stops passing the current through the solenoid 30 of the electromagnetic actuator 27 to thereby move the movable part 28 of the electromagnetic actuator 27 from the closing-side position to the opening-side position, thereby opening the flow regulating valve 23.

However, when the ECU 40 performs the valve-opening control of the high pressure pump 14, the movable part 28 and the flow regulating valve 23 collide with a stopper part 41*a* and the like to thereby cause vibrations, whereas when the ECU 40 performs the valve-closing control of the high pressure pump 14, the movable part 28 of the electromagnetic actuator 27 collides with a stopper part 41*b* to thereby cause vibrations. These vibrations might cause unpleasant noises, and for example, when a vehicle runs at low speeds or stops, a driver easily hears the noises caused when the ECU 40 performs the valve-closing control.

As shown in FIG. 4, when the ECU 40 performs the valve-opening control of the high pressure pump 14, even if the ECU 40 stops passing the current through the solenoid 30, when the fuel pressure in the pump chamber 17 is high, even if the movable part 28 hits the flow regulating valve 23 (pressing portion 24), the flow regulating valve 23 is held at a valve-closing state by the fuel pressure in the pump chamber 17, so that the movable part 28 is stopped in a state where the movable part 28 hits the flow regulating valve 23 (pressing portion 24). Then, if the fuel pressure in the pump chamber 17 is decreased, the movable part 28 is moved to the valve opening-side position and the flow regulating valve 23 is opened.

Figure 6:
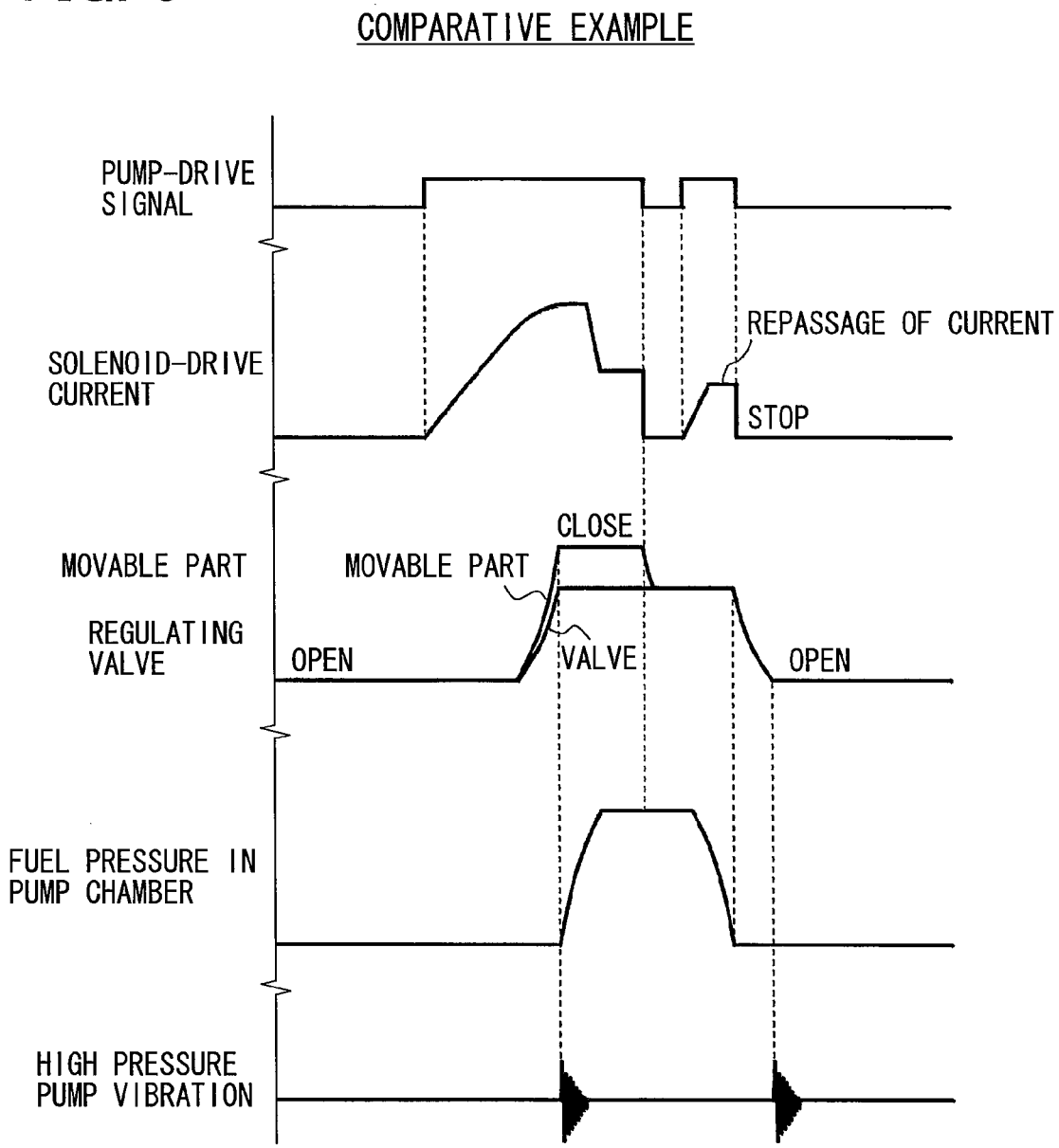
FIG. 6 is a chart to illustrate a valve-opening control of a comparative example.

For this reason, when the ECU 40 performs the valve-opening control of the high pressure pump 14 by the use of the related art, as is the case of a comparative example shown in FIG. 6, even if the ECU 40 stops passing the current through the solenoid 30 at the same timing as in a normal valve-opening control and then again temporarily passes the current through the solenoid 30, there is a possibility that the ECU 40 might pass the current through the solenoid 30 when the movable part 28 hits the flow regulating valve 23 (pressing portion 24) and stops there. In this case, when the fuel pressure in the pump chamber 17 is decreased thereafter and hence cannot decrease a moving speed when the movable part 28 is moved to the valve opening-side position, which hence makes it difficult to reduce the noises caused when the ECU 40 performs the valve-opening control.

Figure 5:
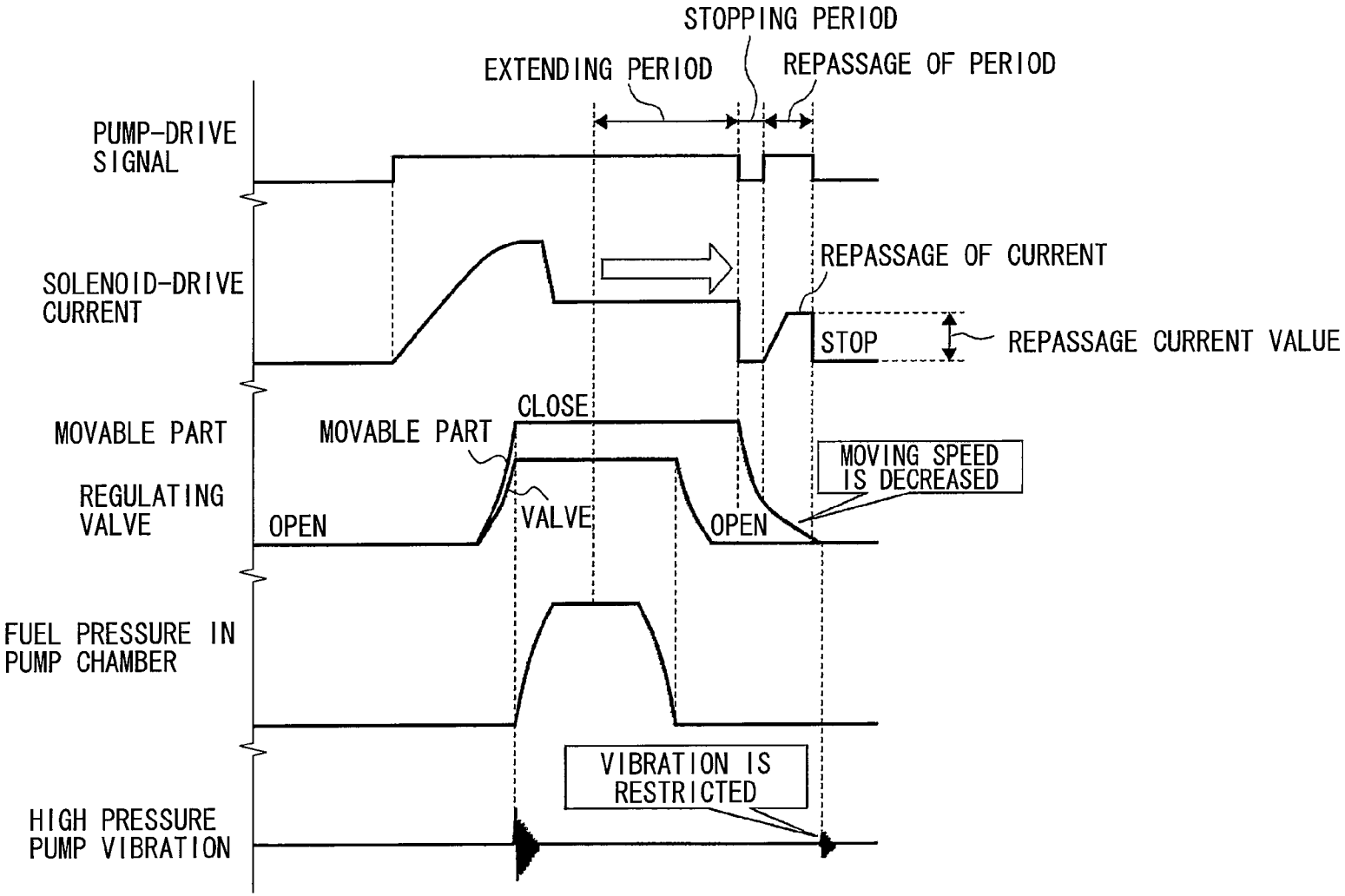
FIG. 5 is a chart to illustrate a valve-opening control for reducing sound.

In the present embodiment, when the ECU 40 executes a valve-opening control routine shown in FIG. 17, which will be described later, to thereby perform the valve-opening control (in other words, stop passing the current through the solenoid 30 of the electromagnetic actuator 27 to thereby move the movable part 28 from the closing-side position to the opening-side position and to thereby open the flow regulating valve 23), if a given sound reducing control performing condition is fulfilled, the ECU 40 determines that it is a state in which the driver easily hears the noises caused when the ECU 40 performs the valve-opening control and performs a valve-opening control for reducing sound in order to reduce the noises caused when the ECU 40 performs the valve-opening control, as shown in FIG. 5. When the ECU 40 performs the valve-opening control for reducing sound, the ECU 40 continuously passes the current through the solenoid 30 to thereby hold the movable part 28 at the closing-side position until the fuel pressure in the pump chamber 17 is decreased to thereby open the flow regulating valve 23, and then after the flow regulating valve 23 is opened, the ECU 40 once stops passing the current through the solenoid 30. In this way, the movable part 28 does not hit the flow regulating valve 23 and stops there, but moves toward the opening-side position. Then, before the movable part 28 reaches the opening-side position, the ECU 40 again temporarily passes the current through the solenoid 30. In this way, the ECU 40 temporarily generates the electromagnetic attracting force of the solenoid 30 to thereby reduce the moving speed when the movable part 28 is moved to the closing-side position is decreased by the electromagnetic attracting force.

When the ECU 40 performs the valve-opening control for reducing sound, the ECU 40 needs to continuously pass the current through the solenoid 30 to thereby hold the movable part 28 at the closing-side position until the fuel pressure in the pump chamber 17 is decreased to a value smaller than a given value (a fuel pressure at which the flow regulating valve 23 is opened) to thereby open the flow regulating valve 23.

A relationship between an amount of lift "L" of a cam (an amount of lift of the plunger 18) and the fuel pressure "P" in the pump chamber 17 can be expressed by the following formula (1) by the use of a volume "V" of the pump chamber 17, a bulk modulus "E" of the fuel, and an area "S" of the plunger 18.

$$L=P\times V/(E\times S) \quad (1)$$

From the above formula (1), as the fuel pressure in the pump chamber 17 becomes higher, an amount of decrease in the amount of lift "L" of the cam necessary for making the fuel pressure "P" to the given value or less becomes larger, which hence further elongates a period which elapses until the fuel pressure "P" becomes the given value or less.

Figure 7:
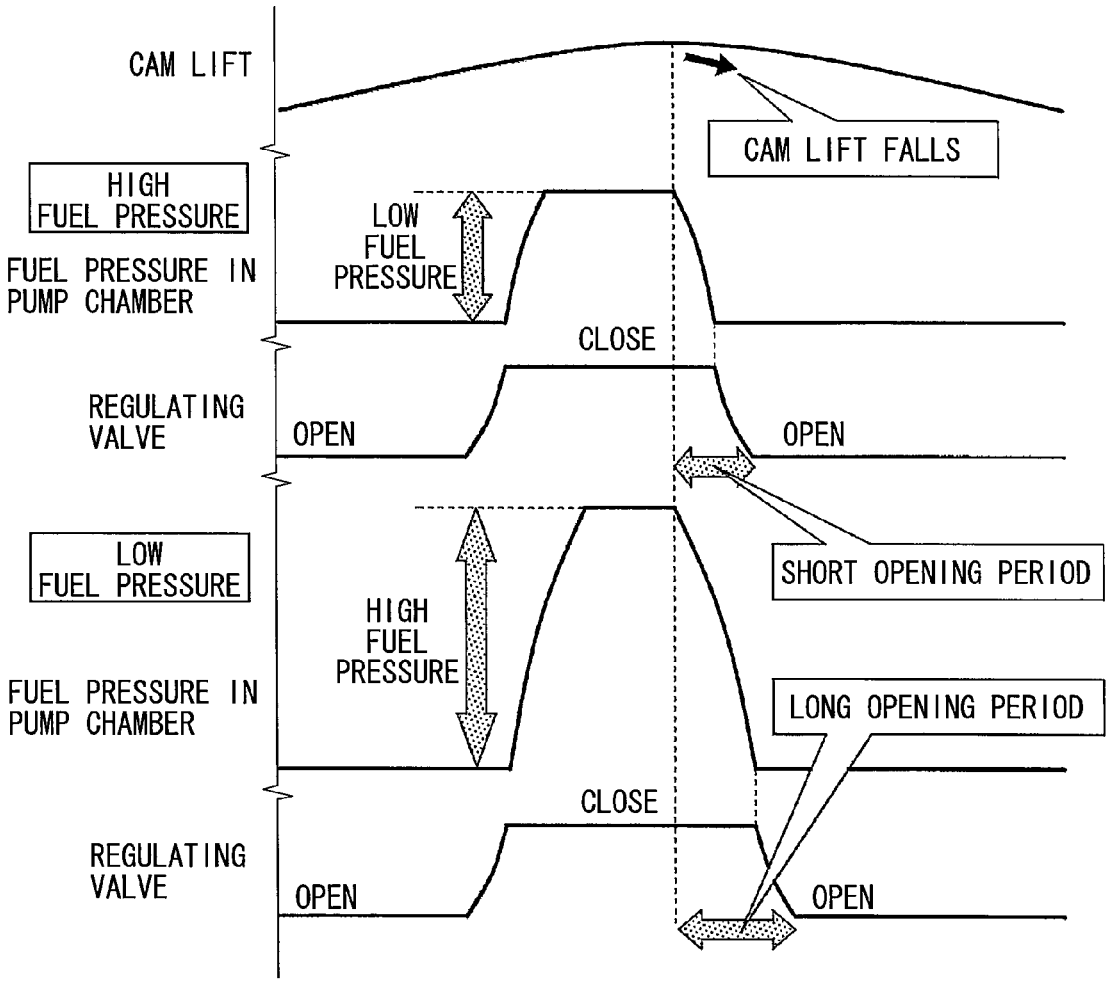
FIG. 7 is a chart to illustrate a relationship between a peak value of a fuel pressure and a period during which a flow regulating valve is opened.
Figure 8:
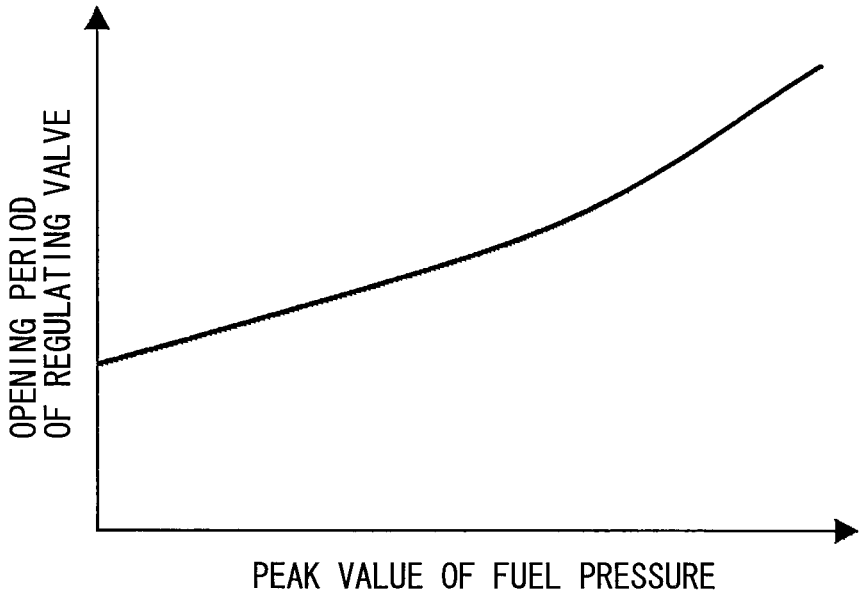
FIG. 8 is a graph to show a relationship between a peak value of a fuel pressure and a period during which a flow regulating valve is opened.

For this reason, as shown in FIG. 7, as a peak value of the fuel pressure in the pump chamber 17 becomes higher, a period which elapses until the fuel pressure becomes the given value (the fuel pressure at which the flow regulating valve 23 is opened) or less becomes longer and hence a flow regulating valve opening period (a period from the time when the fuel pressure starts to decrease to the time when the flow regulating valve 23 is opened) becomes longer. In other words, as shown in FIG. 8, the high pressure pump 14 has a characteristic such that as the peak value of the fuel pressure in the pump chamber 17 becomes higher, the flow regulating valve opening period becomes longer.

In the present embodiment, at the time of performing the valve-opening control for reducing sound, a period during which the movable part 28 is held at the closing-side position is changed according to the peak value of the fuel pressure in the pump chamber 17. Specifically, as the peak value of the fuel pressure in the pump chamber 17 becomes higher, a passage-of-current extending period (in other words, a period during which the passage of the current through the solenoid 30 is extended as compared with the timing when the passage of the current through the solenoid 30 is stopped in the normal valve-opening control) is further elongated to thereby further elongate a period during which the movable part 28 is held at the closing-side position. This makes it possible to change a period during which the movable part 28 is held at the closing-side position in response to a change of the flow regulating valve opening period according to the peak value of the fuel pressure in the pump chamber 17. In this way, even if the flow regulating valve opening period is changed by a change in the peak value of the fuel pressure, the movable part 28 can be surely held at the closing-side position until the flow regulating valve 23 is opened.

Figure 9:
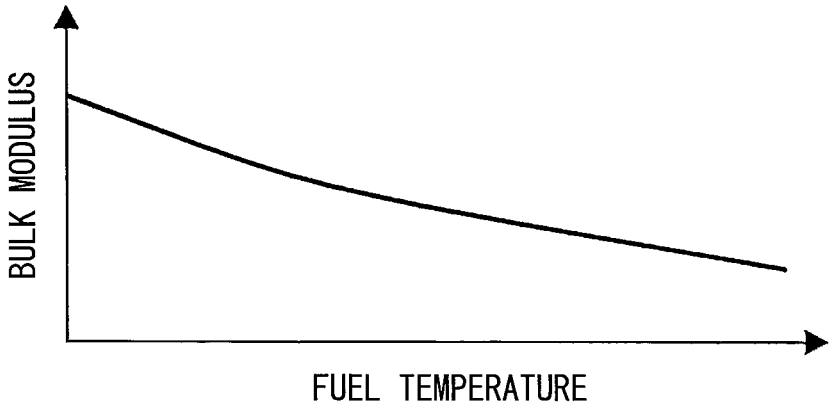
FIG. 9 is a graph to show a relationship between a fuel temperature and a bulk modulus.
Figure 10:
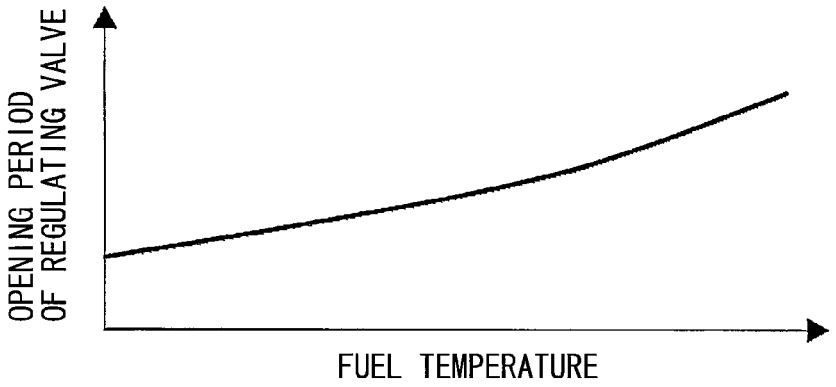
FIG. 10 is a graph to show a relationship between a fuel temperature and a period during which a flow regulating valve is opened.

As shown in FIG. 9, as a fuel temperature becomes higher, the bulk modulus of the fuel becomes smaller. In addition, from the formula (1), as the bulk modulus "E" of the fuel becomes smaller, the amount of decrease in the amount of lift "L" of the cam necessary for making the fuel pressure "P" the given value or less becomes larger and hence the period which elapses until the fuel pressure "P" becomes the given value or less becomes longer (in other words, the flow regulating valve opening period becomes longer). For this reason, as shown in FIG. 10, the high pressure pump 14 has a characteristic such that as the fuel temperature becomes higher, the flow regulating valve opening period becomes longer.

In the present embodiment, at the time of performing the valve-opening control for reducing sound, the period during which the movable part 28 is held at the closing-side position is changed according to the fuel temperature. Specifically, as the fuel temperature becomes higher, the passage-of-current extending period is further elongated to thereby further elongate the period during which the movable part 28 is held at the closing-side position. In this way, in response to the flow regulating valve opening period being changed according to the fuel temperature, the period during which the movable part 28 is held at the closing-side position can be changed. In this way, even if the flow regulating valve opening period is changed according to a change in the fuel temperature, the movable part 28 can be surely held at the closing-side position until the flow regulating valve 23 is opened. The fuel temperature may be detected by a temperature sensor, but a coolant temperature or an oil temperature may be used as substitute information of the fuel temperature. Alternatively, the fuel temperature may be estimated on the basis of the coolant temperature or the oil temperature.

Figure 11:
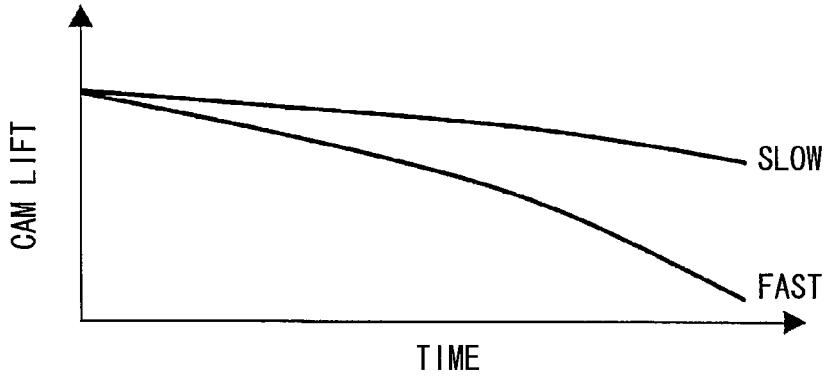
FIG. 11 is a graph to show an effect of a cam profile.
Figure 12:
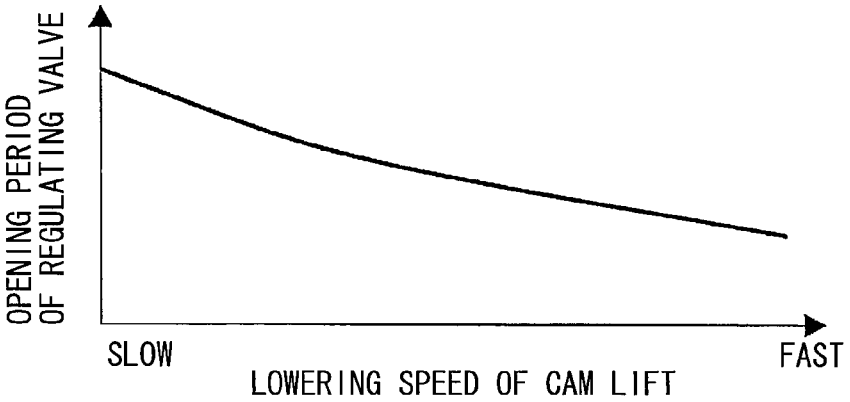
FIG. 12 is a graph to show a relationship between a lowering speed of a cam lift amount and a period during which a flow regulating valve is opened.

As shown in FIG. 11, a lowering speed of the cam lift amount is varied according to a difference in a cam profile (shape of the cam 20). In addition, as shown in FIG. 12, as the lowering speed of the cam lift amount becomes higher, the flow regulating valve opening period becomes shorter. In other words, the flow regulating valve opening period is varied according to the cam profile.

In the present embodiment, the period during which the movable part 28 is held at the closing-side position is changed according to the cam profile. Specifically, as the lowering speed of the cam lift amount becomes higher according to the difference in the cam profile, the passage-of-current extending period is made shorter to thereby shorten the period during which the movable part 28 is held at the closing-side position. This makes it possible to change the period during which the movable part 28 is held at the closing-side position in response to the flow regulating valve opening period being varied according to the cam profile. In this way, even if the flow regulating valve opening period is varied according to the difference in the cam profile, the movable part 28 can be surely held at the closing-side position until the flow regulating valve 23 is opened.

In a case where "the passage-of-current extending period" is set by "time", the flow regulating valve opening period (time) is varied according to the rotation speed of the cam 20, so that the passage-of-current extending period (time) is changed according to the rotation speed of the cam 20 to thereby change the period (time) during which the movable part 28 is held at the closing-side position. This makes it possible to change the period (time) during which the movable part 28 is held at the closing-side position in response to the flow regulating valve opening period (time) being varied according to the rotation speed of the cam 20. In this way, even if the flow regulating valve opening period (time) is varied according to a change in the rotation speed of the cam 20, the movable part 28 can be surely held at the closing-side position until the flow regulating valve 23 is opened.

In this regard, in a case where "the passage-of-current extending period" is set by "a cam angle or a crank angle", the flow regulating valve opening period is not affected by the rotation speed of the cam 20, so that the passage-of-current extending period does not need to be changed according to the rotation speed of the cam 20.

In the present embodiment, at the time of performing the valve-opening control for reducing sound, the current is again temporarily passed through the solenoid 30 before the movable part 28 reaches the opening-side position. However, as shown in FIG. 13, if a current value at the time of again temporarily passing the current through the solenoid 30 is excessively large, the electromagnetic attracting force of the solenoid 30 becomes excessively large, which raises a possibility that the movable part 28 might be returned in the direction of the closing-side position.

Figure 13:
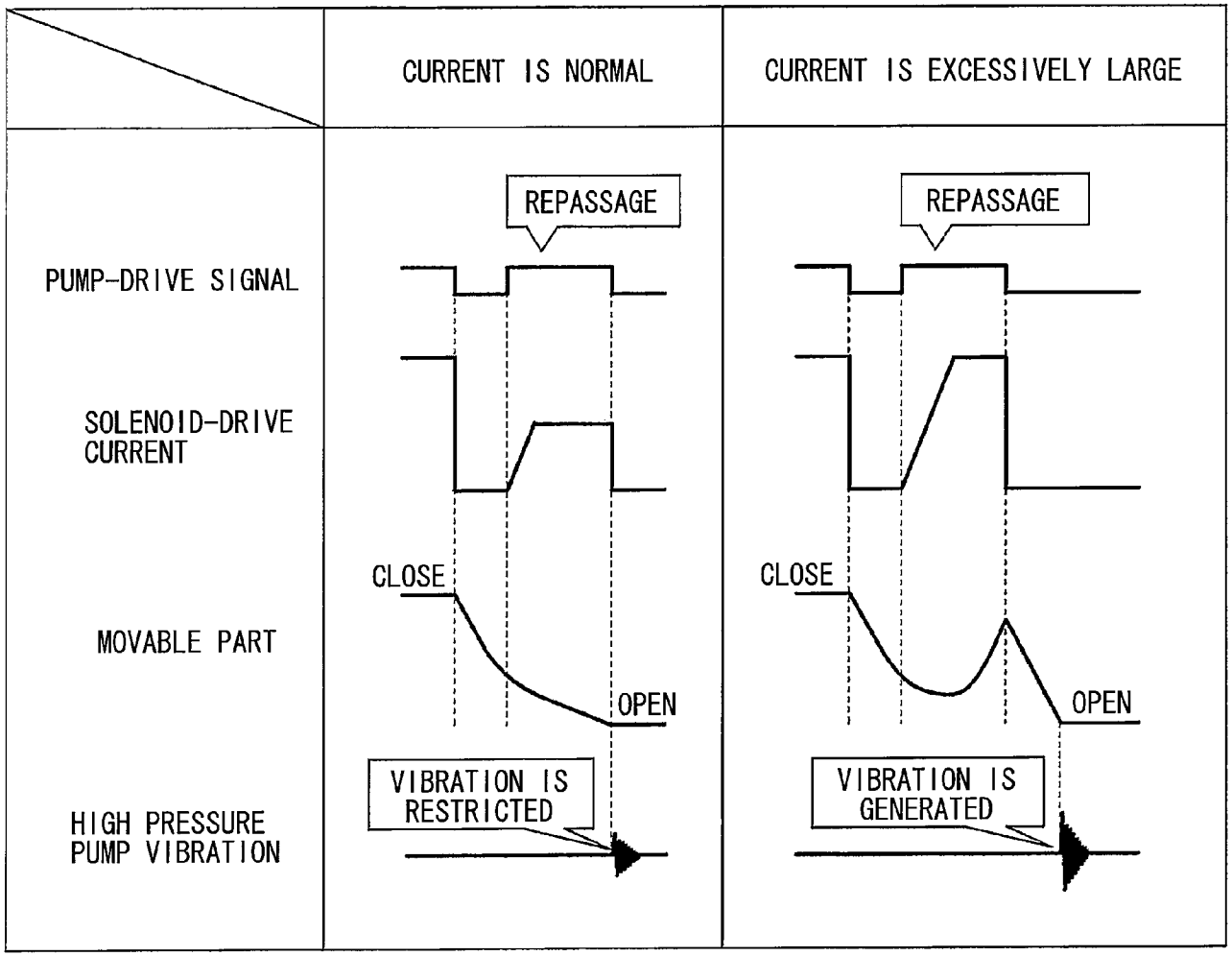
FIG. 13 is a chart to illustrate a method for setting a current value when current is again passed through a solenoid.

In the present embodiment, as shown in FIG. 13, the current value at the time of again passing the current through the solenoid 30 is set within a range in which the movable part 28 is not moved back in the direction of the closing-side position. In this way, when the current is again temporarily passed through the solenoid 30 before the movable part 28 reaches the opening-side position, it is possible to prevent the movable part 28 from being moved back in the direction of the closing-side position.

Figure 14:
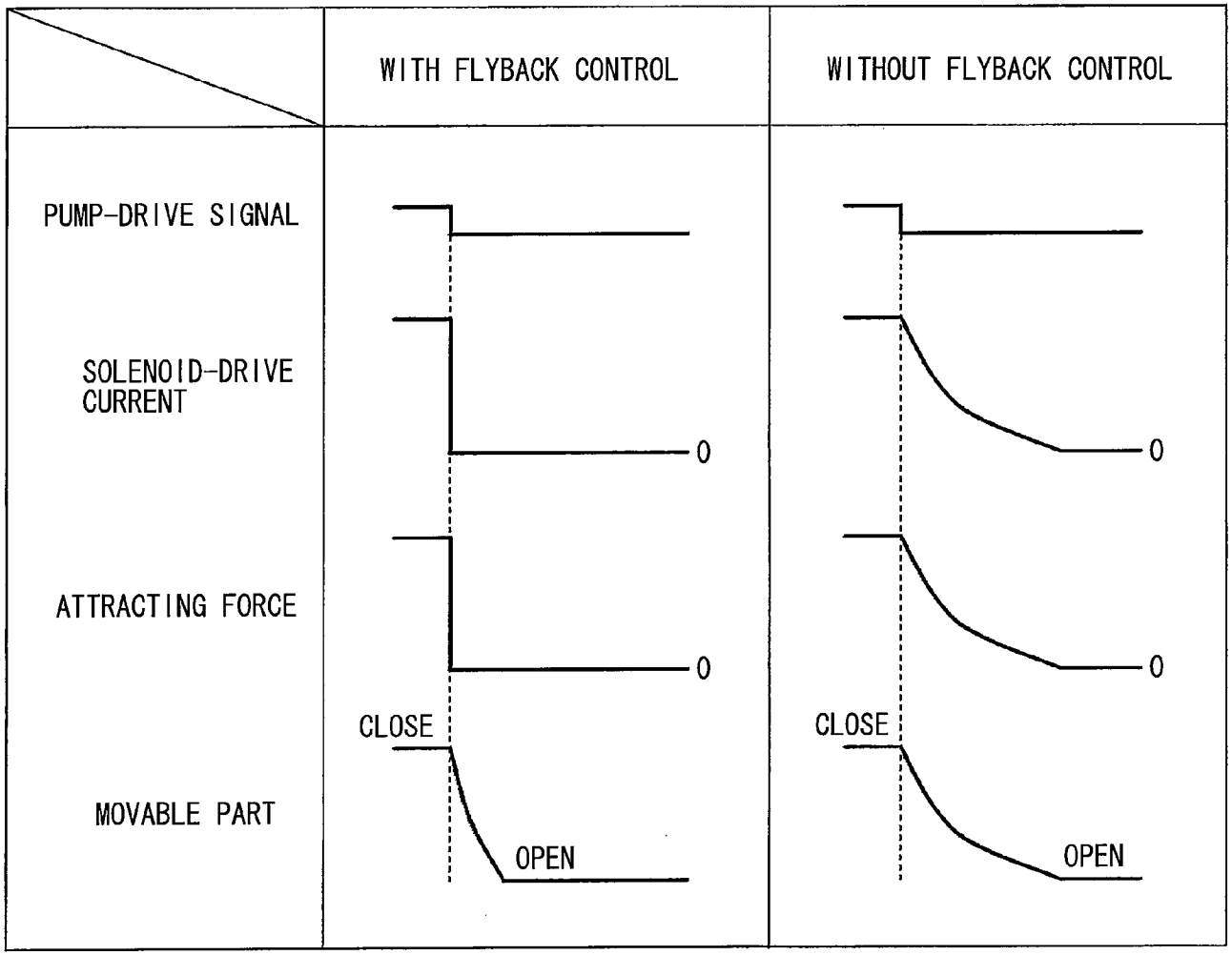
FIG. 14 is a chart to illustrate a flyback control.

In the present embodiment, at the time of performing the valve-opening control for reducing sound, the passage of current through the solenoid 30 is once stopped after the movable part 28 is opened. However, as shown in FIG. 14, in a case where a flyback control, which will be described later, is not performed, when the passage of current through the solenoid 30 is once stopped, the current flowing through the solenoid 30 is slowly decreased by a back electromotive force. For this reason, the electromagnetic attracting force of the solenoid 30 is generated also after the passage of current through the solenoid 30 is stopped and hence a motion when the movable part 28 is moved to the opening-side position is varied by the effect of the electromagnetic attracting force, which hence makes it difficult to set the timing when the current is again passed through the solenoid 30.

In the present embodiment, as shown in FIG. 14, the flyback control is performed in a flyback circuit 46 (see FIG. 15) for removing the current which flows through the solenoid 30 by the back electromotive force when the passage of current through the solenoid 30 is once stopped. In this way, after the passage of current through the solenoid 30 is once stopped, the electromagnetic attracting force of the solenoid 30 is hardly generated and hence the motion when the movable part 28 is moved to the opening-side position is stabilized, which hence makes it possible to easily set the timing when the current is again passed through the solenoid 30.

Figure 15:
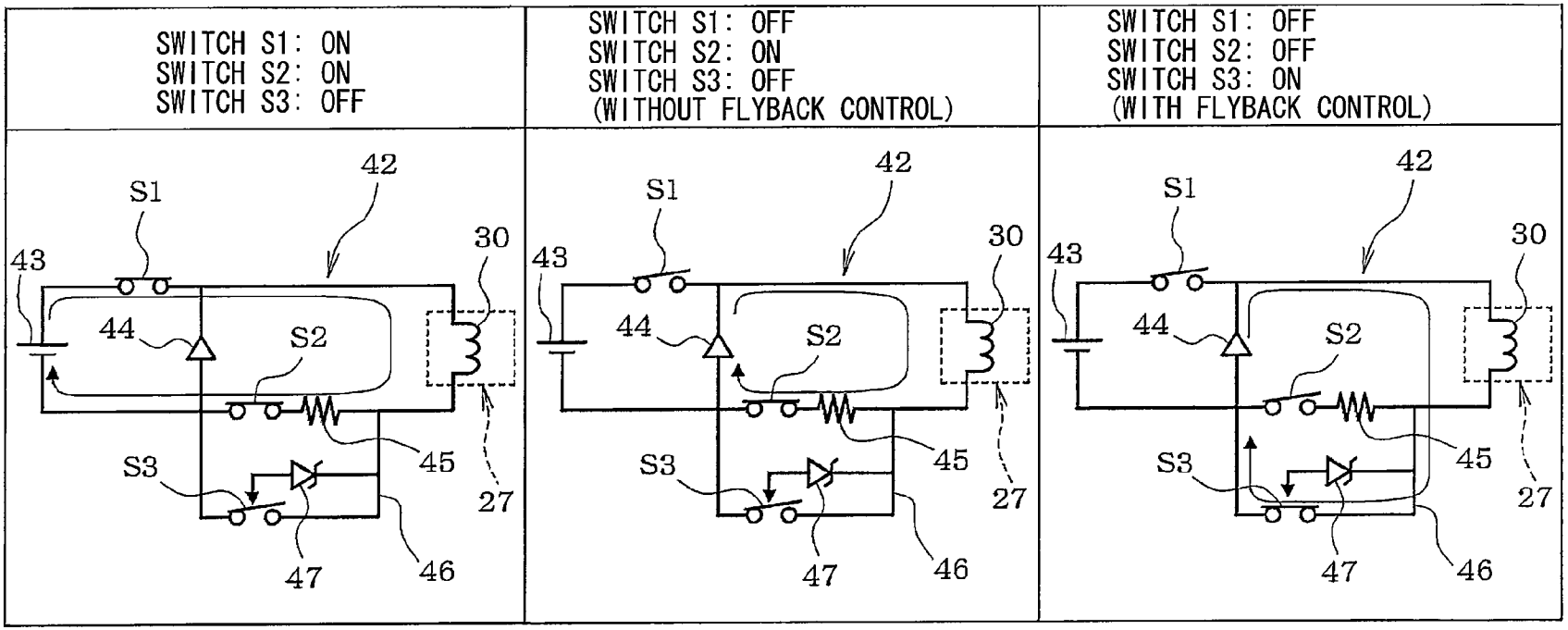
FIG. 15 is a schematic construction diagram of a drive circuit of a solenoid.

Specifically, as shown in FIG. 15, in a drive circuit 42 of the solenoid 30, the solenoid 30 and a diode 44 are connected in parallel to a battery 43 and a switch S1 is connected between the battery 43 and the diode 44, and a switch S2 and a resistance 45 are connected between the diode 44 and the solenoid 30. In addition, the flyback circuit 46 is connected in parallel to the switch S2 and the resistance 45. The flyback circuit 46 is constructed of a Zener diode 47 and a switch S3.

Usually (in a case the flyback control is not performed), as shown in FIG. 15, when the switch S1 is turned on or off in a state where the switch S2 is on, the passage of current through the solenoid 30 is put on or off (performed or stopped).

Figure 16:
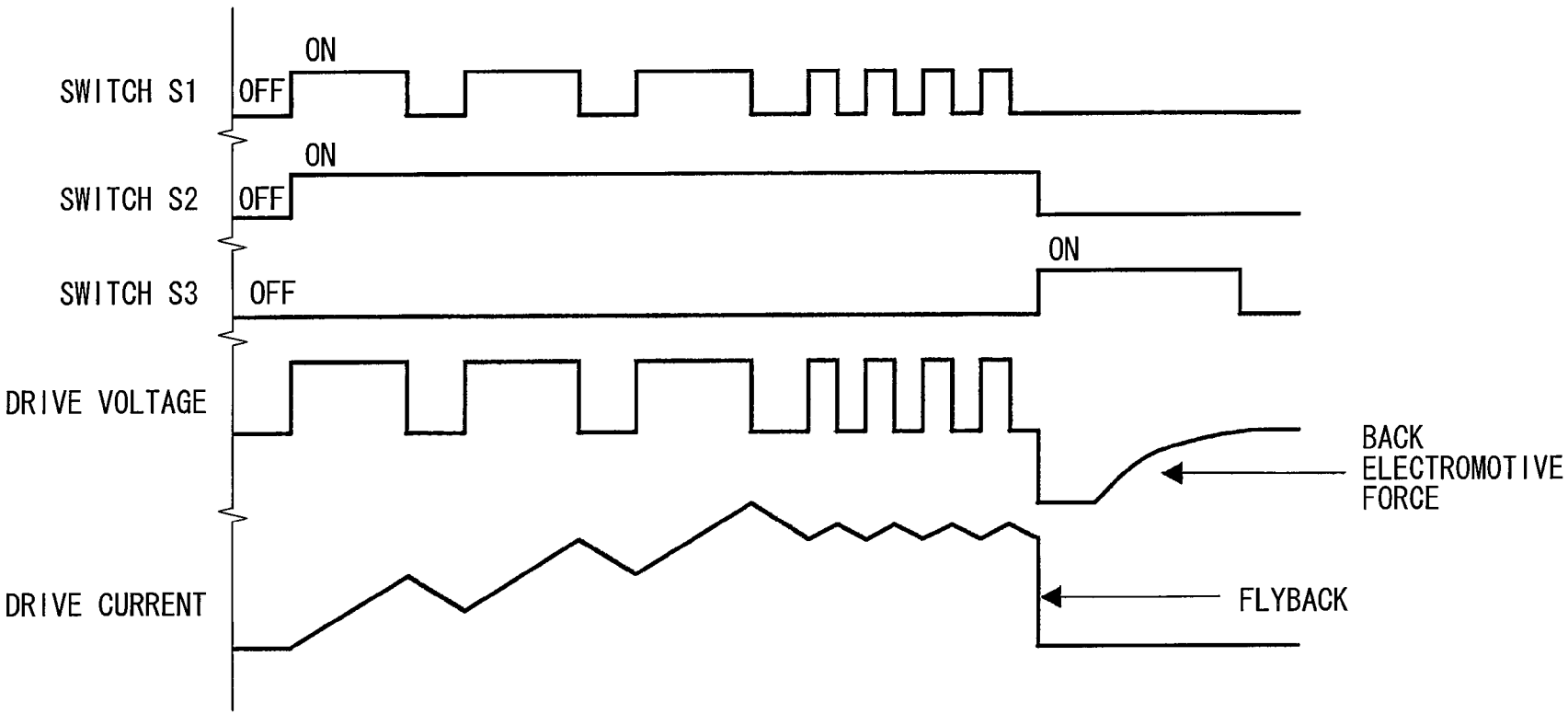
FIG. 16 is a time chart to show an example of performing a flyback control.

On the other hand, in a case the flyback control is performed at the time of stopping passing the current through the solenoid 30, as shown in FIG. 15, the switch S2 is turned off and the switch S3 is turned on at the same time. In this way, the flyback control is performed as follows: that is, energy stored in the solenoid 30 is transformed to the back electromotive force while being limited by the Zener diode 47 to quickly decrease the current flowing through the solenoid 30, thereby removing the current (see FIG. 16).

Figure 17:
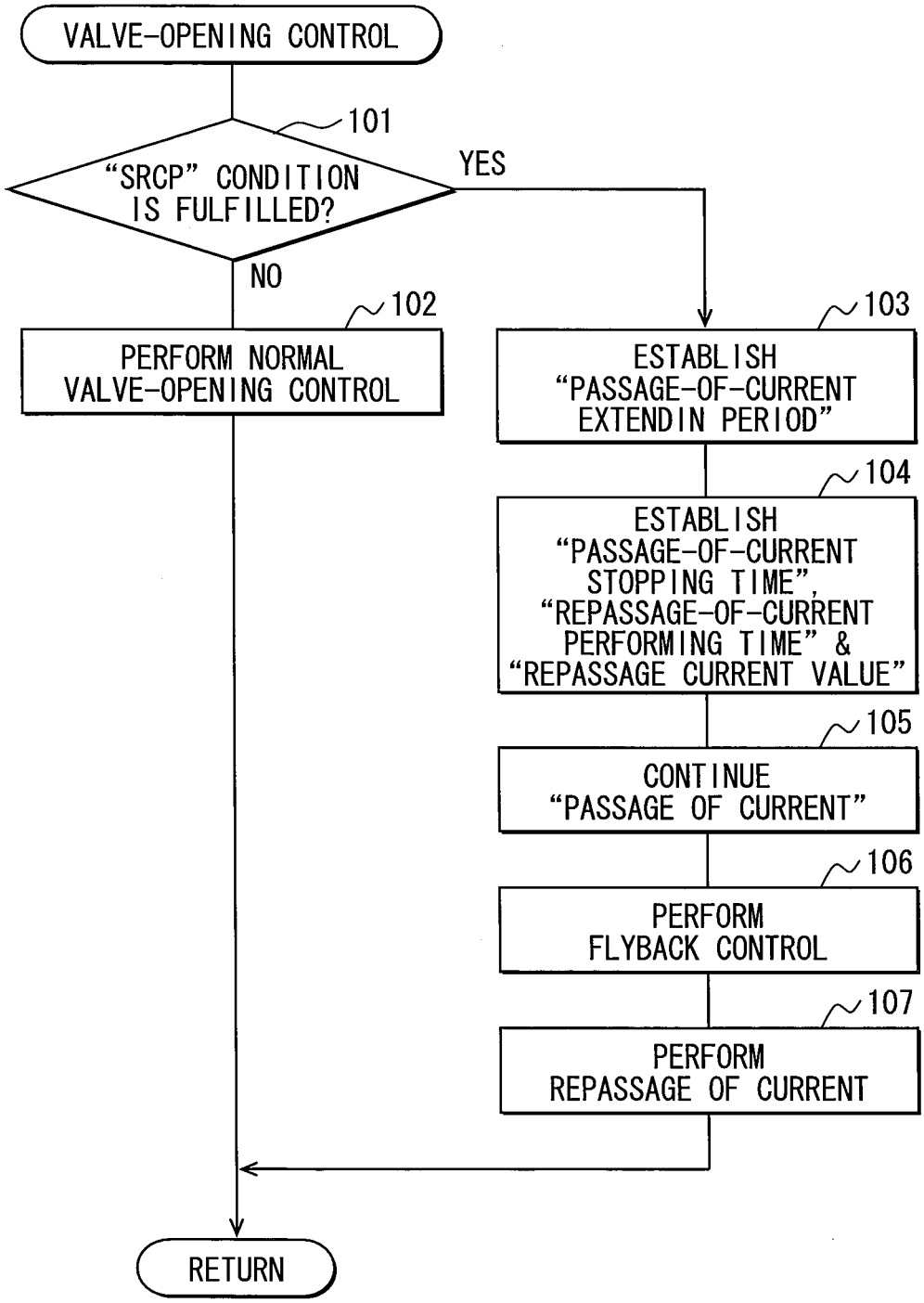
FIG. 17 is a flow chart to show a processing flow of a valve-opening control routine.

The valve-opening control of the high pressure pump 14 of the present embodiment described above is performed by the ECU 40 according to a valve-opening control routine shown in FIG. 17. The processing contents of the valve-opening control routine will be described.

The valve-opening control routine shown in FIG. 17 is repeatedly performed at given intervals in a period during which the power of the ECU 40 is on (in a period during which an ignition switch is on), whereby the ECU 40 acts as a valve-opening control portion. In step 101, whether or not a sound-reducing-control-performing (SRCP) condition is fulfilled is determined by whether or not all of the following conditions (1) to (5) are satisfied.

(1) A battery voltage is in a stable state (battery voltage>given value).

(2) A vehicle is running at a low speed or is standing (vehicle speed≤given value).

(3) An accelerator is off (accelerator opening=0).

(4) An engine rotation speed is in a stable state.

(|target rotation speed−engine rotation speed|≤given value)

(5) A fuel pressure is in a stable state.

(|target fuel pressure−fuel pressure|≤given value)

The conditions of (2) and (3) are conditions used for determining whether or not noises caused when the valve-opening control is performed are in a state where the driver easily hears the noises.

If all of the conditions of (1) to (5) are satisfied, the sound reducing control performing (SRCP) condition is fulfilled, whereas if any one of the conditions of (1) to (5) is not satisfied, the sound reducing control performing condition is not fulfilled.

In a case where it is determined in step 101 that the sound reducing control performing (SRCP) condition is not fulfilled, the processing proceeds to step 102 where a normal valve-opening control (see FIG. 4) is performed. In the normal valve-opening control, when the fuel pressure in the pump chamber 17 becomes high, the passage of current through the solenoid 30 of the electromagnetic actuator 27 is stopped. In this case, the flow regulating valve 23 is held in a state where the flow regulating valve 23 is closed by the fuel pressure in the pump chamber 17, so that the movable part 28 stops in a state where the movable part 28 abuts on the flow regulating valve 23 (pressing portion 24). Then, when the fuel pressure in the pump chamber 17 is decreased, the movable part 28 is moved to the opening-side position and the flow regulating valve 23 is opened.

In a case where it is determined in step 101 that the SRCP condition is fulfilled, it is determined that noises caused the valve-opening control is performed are in the state where the driver easily hears the noises, and the valve-opening control for reducing sound is performed in the following way. First, in step 103, the "passage-of-current extending period (see FIG. 5)", which is the period during which the passage of current through the solenoid 30 is extended as compared with timing when the passage of current through the solenoid 30 is stopped in the normal valve-opening control), is set by "the cam angle or the crank angle".

In this case, first, the passage-of-current extending period according to the peak value of the fuel pressure in the pump chamber 17 is calculated by a map or a mathematical formula. In this way, as the peak value of the fuel pressure in the pump chamber 17 becomes higher, the passage-of-current extending period is further elongated to thereby further elongate the period during which the movable part 28 is held at the closing-side position. The map or the mathematical formula for calculating the passage-of-current extending period are made previously on the basis of test data or design data and are stored in the ROM of the ECU 40.

A correction value according to the fuel temperature is calculated by a map or a mathematical formula and the passage-of-current extending period is corrected by the use of the correction value. In this way, as the fuel temperature becomes higher, the passage-of-current extending period is further elongated to thereby further elongate the period during which the movable part 28 is held at the closing-side position. In addition, it is also recommended to calculate a correction value according to the cam profile by a map or a mathematical formula and to correct the passage-of-current extending period by the use of the correction value. In this way, as the lowering speed of the cam lift amount becomes higher according to a difference in the cam profile, the passage-of-current extending period is made shorter to thereby further shorten the period during which the movable part 28 is held at the closing-side position. The map or the mathematical formula for calculating the correction value of the passage-of-current extending period are made previously on the basis of test data or design data and are stored in the ROM of the ECU 40.

In this regard, in a case where "the passage-of-current extending period" is set by "time", the flow regulating valve opening period (time) is varied according to the rotation speed of the cam 20, so that the passage-of-current extending period (time) is changed according to the rotation speed of the cam 20 to thereby change the period (time) during which the movable part 28 is held at the closing-side position.

Then, the processing proceeds to step 104 where "a passage-of-current stopping time (see FIG. 5)", which is a period of time from when the passage of current through the solenoid 30 is once stopped to when the passage of current through the solenoid 30 is again started, is set at a given time T1 (for example, 0.5 ms), and where "a repassage-of-current performing time" (see FIG. 5)", which is a period of time during which the passage of current through the solenoid 30 is again started and continuously performed, is set at a given time T2 (for example, 1 ms), and where "a current value of repassage-of-current (see FIG. 5)", which is a current value when the passage of current through the solenoid 30 is again started, is set at a given current value (for example, 3 A). These given time T1, given time T2, given current value are set previously on the basis of test data or design data and are stored in the ROM of the ECU 40.

Then, the processing proceeds to step 105 where the passage of current through the solenoid 30 is continuously performed until the passage-of-current extending period is finished. In this way, the passage of current through the solenoid 30 is continuously performed until the fuel pressure in the pump chamber 17 is decreased to thereby open the flow regulating valve 23, whereby the movable part 28 is held at the closing-side position.

Then, the processing proceeds to step 106 where when the passage-of-current extending period set in the step 103 is finished, the passage of current through the solenoid 30 is once stopped to thereby once stop the passage of current through the solenoid 30 after the flow regulating valve 23 is opened, and where the switch S2 and the switch S3 in the drive circuit 42 of the solenoid 30 are turned on at the same time to thereby perform the flyback control of removing the current flowing through the solenoid 30 by the flyback circuit 46.

Then, the processing proceeds to step 107 where when the passage-of-current stopping time set in step 104 elapses, the passage of current through the solenoid 30 is again performed in the repassage-of-current performing time and with the current value of repassage-of-current, both of which are set in step 104, to thereby again temporarily perform the passage of current through the solenoid 30 before the movable part 28 reaches the opening-side position. In this way, the electromagnetic attracting force of the solenoid 30 is temporarily generated to thereby decrease the moving speed when the movable part 28 is moved to the opening-side position by the electromagnetic attracting force.

In the present embodiment described above, when the valve-opening control is performed (in other words, when the passage of current through the solenoid 30 of the electromagnetic actuator 27 is stopped to thereby move the movable part 28 from the closing-side position to the opening-side position and to thereby open the flow regulating valve 23), if the given SRCP condition is fulfilled, it is determined that noises caused when the valve-opening control is performed is in the state where the driver easily hears the noises and hence the valve-opening control for reducing sound is performed. In the valve-opening control for reducing sound, the passage of current through the solenoid 30 is continuously performed until the fuel pressure in the pump chamber 17 is decreased to thereby open the flow regulating valve 23, thereby holding the movable part 28 at the closing-side position, and then after the flow regulating valve 23 is opened, the passage of current through the solenoid 30 is once stopped. In this way, the movable part 28 does not hit and stop at the flow regulating valve 23 but moves to the opening-side position. Then, the passage of current through the solenoid 30 is again temporarily performed before the movable part 28 reaches the opening-side position. In this way, it is possible to temporarily generate the electromagnetic attracting force of the solenoid 30 and to decrease the moving speed when the movable part 28 is moved to the opening-side position by the electromagnetic attracting force. In this way, it is possible to prevent vibrations caused when the movable part 28 reaches the opening-side position and hence to reduce the noises caused when the valve-opening control is performed.

In this regard, in the embodiment described above, the period during which the movable part 28 is held at the closing-side position is changed according to the peak value of the fuel pressure and the fuel temperature in the pump chamber 17. However, the period during which the movable part 28 is held at the closing-side position is not limited to this but may be fixed at a predetermined period (period not less than a maximum value of a period during which the flow regulating valve 23 is held opened).

[Second Embodiment]

Figure 18:
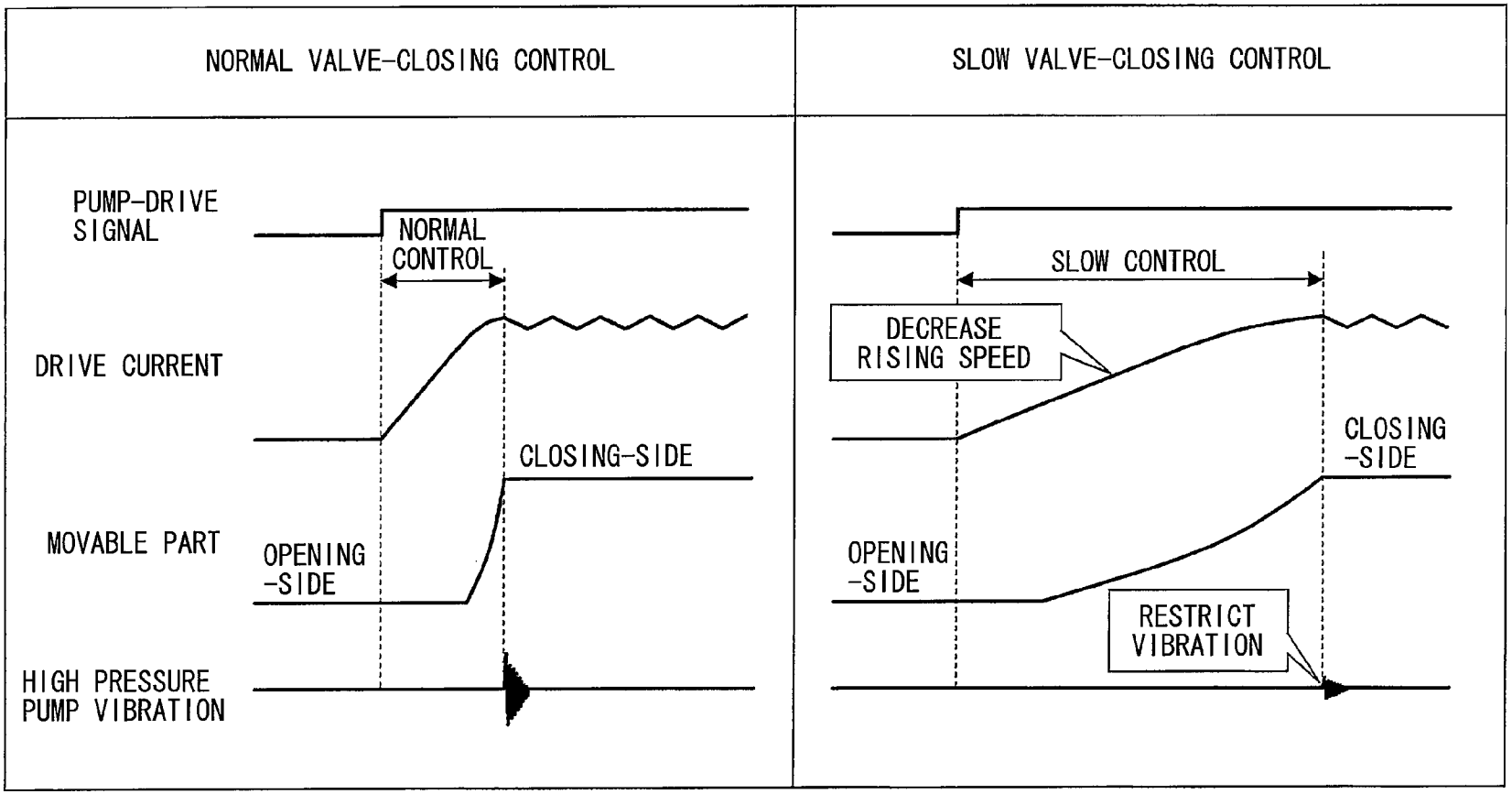
FIG. 18 is a chart to illustrate a normal valve-closing control and a slow valve-closing control.

In an second embodiment, when the ECU 40 executes a valve-closing control routine shown in FIG. 25, which will be described later, to thereby perform a normal valve-closing control (in other words, when the ECU 40 passes a drive current through the solenoid 30 of the electromagnetic actuator 27 to thereby move the movable part 28 to the closing-side position, thereby closing the flow regulating valve 23), if a given slow valve-closing control performing condition is not fulfilled (for example, if there is brought about a state where the driver hardly hears noises caused when the valve-closing control is performed), as shown in FIG. 18, the ECU 40 performs a normal valve-closing control.

In the normal valve-closing control, a drive voltage of the solenoid 30 is continuously held in an on state to thereby increase the drive current of the solenoid 30 quickly to a convergent current value of the normal valve-closing control. In this way, the electromagnetic attracting force of the solenoid 30 is quickly increased to thereby quickly move the movable pat 28 to the closing-side position. Here, the convergent current value of the normal valve-closing control is set at a current value large enough to make the electromagnetic attracting force of the solenoid 30 larger than a biasing force of a spring 29 for biasing the movable part 28 on a valve opening side.

It is known that the biasing force of the spring 29 is determined by a spring constant and a moving range of the movable part 28 and that the electromagnetic attracting force of the solenoid 30 is determined by the resistance of a coil, the number of windings of the coil, and a supply voltage, but these parameters are varied according to variations in manufacture and a use environment (drive voltage and temperature).

For this reason, if the smallest value (minimum value) necessary for making the electromagnetic attracting force of the solenoid 30 larger than the biasing force of the spring 29 for biasing the movable part 28 to the valve opening side is set as the convergent current value with no consideration for these variations (variations caused by the variations in manufacture and in use environment), a faulty valve closing operation is likely caused by a shortage of current. Thus, in the present embodiment, a value (for example, 6 A) having a sufficient margin for the minimum value (for example, 4 A) is set as the convergent current value.

On the other hand, if the given slow valve-closing control performing condition is fulfilled, it is determined that there is brought about a state where the driver easily hears the noises caused when the valve-closing control is performed, and in order to reduce the noises caused when the valve-closing control is performed, as shown in FIG. 18, a slow valve-closing control for making a rate of rise (rising speed) of the drive current of the solenoid 30 smaller than in the normal valve-closing control is performed. In this way, the electromagnetic attracting force of the solenoid 30 is slowly increased to thereby decrease the moving speed of the movable part 28.

Figure 19:
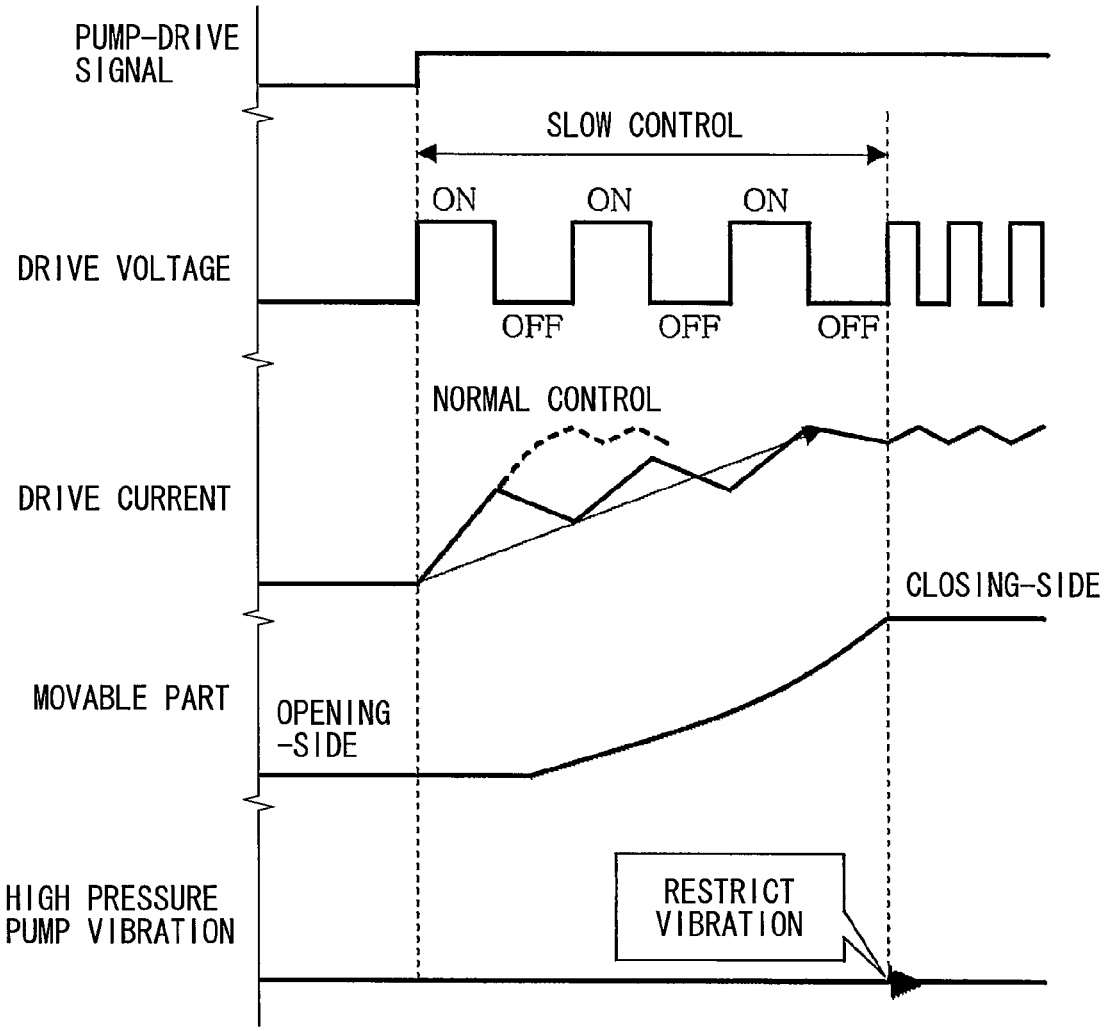
FIG. 19 is a chart to illustrate a slow valve-closing control of an second embodiment.

Specifically, as shown in FIG. 19, when the slow valve-closing control is performed, the drive voltage of the solenoid is repeatedly put on and off (applied and stopped applying) to thereby make an average of the rate of rise of the drive current of the solenoid 30 smaller than in the normal valve-closing control.

Figure 20:
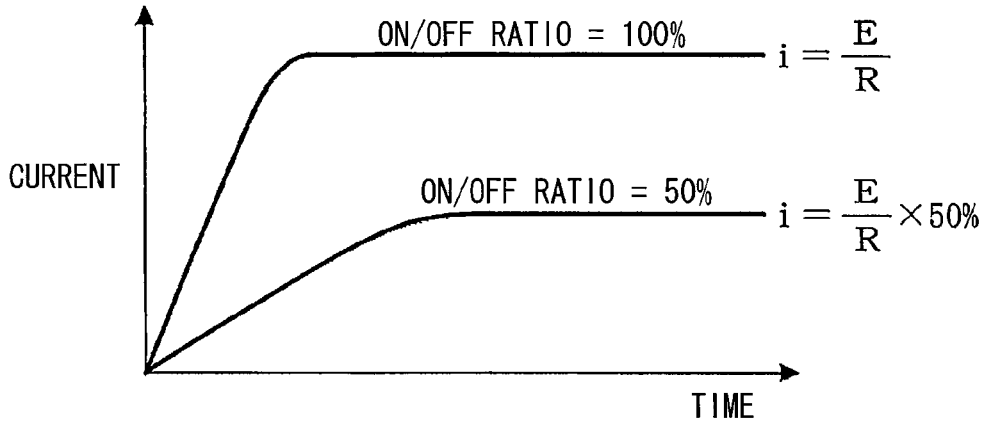
FIG. 20 is a chart to illustrate a convergent current value.

Since the solenoid 30 of the high pressure pump 14 is a LR circuit, as shown in FIG. 20, when the drive voltage is continuously applied to the solenoid 30, the current flowing through the solenoid 30 is finally converged to a convergent current value "i" determined by a drive voltage "E" and a resistance "R", but in a case where the drive voltage of the solenoid 30 is repeatedly put on and off, the convergent current value "i" is varied according to an "on" and "off" ratio of the drive voltage (a ratio of time during which the drive voltage is on to time during which the drive voltage is off). Here, the on and off ratio is assumed, for example, to be a ratio of the time during which the drive voltage is on to (the time during which the drive voltage is on+the time during which the drive voltage is off).

Figure 21:
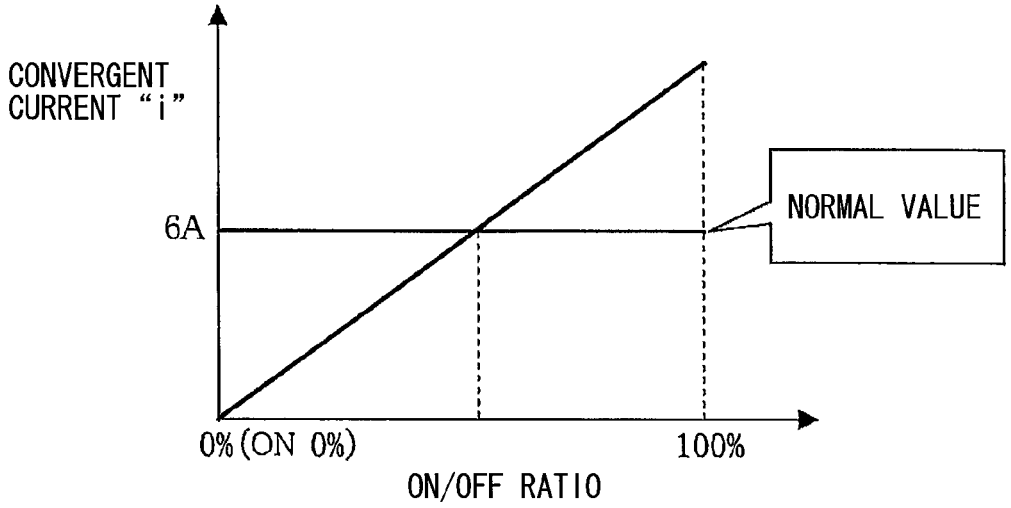
FIG. 21 is a graph to show a relationship between an on and off ratio and a convergent current value.
Figure 22:
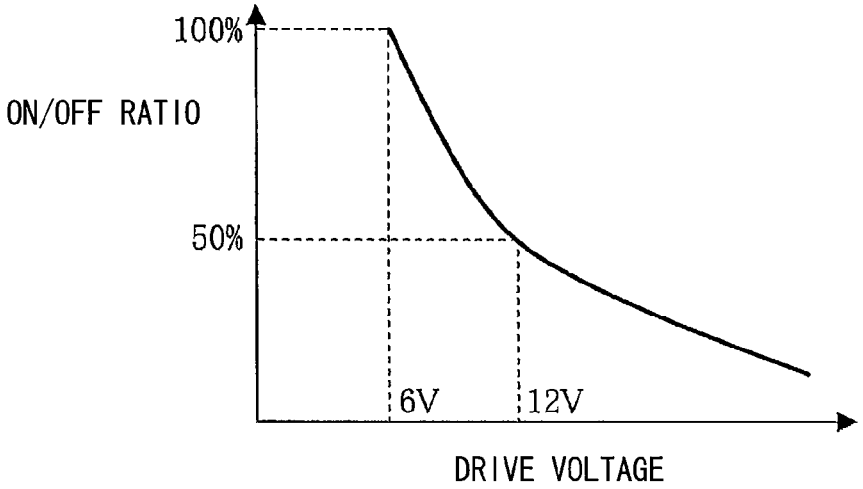
FIG. 22 is a graph to show a relationship between a drive voltage and an on and off ratio.

In consideration of these circumstances, as shown in FIG. 21, when the slow valve-closing control is performed, the on and off ratio of the drive voltage is set at a given ratio (for example, 50%) in such a way that the convergent current value "i" becomes a value (for example, 6 A) equal to the convergent current value of the normal valve-closing control (in a case where the driver is guarded by a given upper limit, the given upper limit value).

When the drive voltage of the solenoid 30 is varied, the convergent current value is varied, so that as shown in FIG.

22, when the slow valve-closing control is performed, the on and off ratio is changed according to the drive voltage to thereby correct the on and off ratio of the drive voltage in such a way that the convergent current voltage becomes equal to the convergent current voltage of the normal valve-closing control. In addition, when the temperature of the solenoid 30 is varied, the resistance value of the solenoid 30 is varied and hence the convergent current value is varied, so that the on and off ratio of the drive voltage is changed according to the temperature (or resistance value estimated from the temperature) to thereby correct the on and off ratio of the drive voltage in such a way that the convergent current value "i" becomes the value (for example, 6 A) equal to the convergent current value of the normal valve-closing control. In this way, by changing the on and off ratio of the drive voltage according to the drive voltage and the temperature of the solenoid, it is possible to set the on and off ratio of the drive voltage at a suitable value (a ratio at which the convergent current value "i" becomes equal to the convergent current value of the normal valve-closing control).

Figure 23:
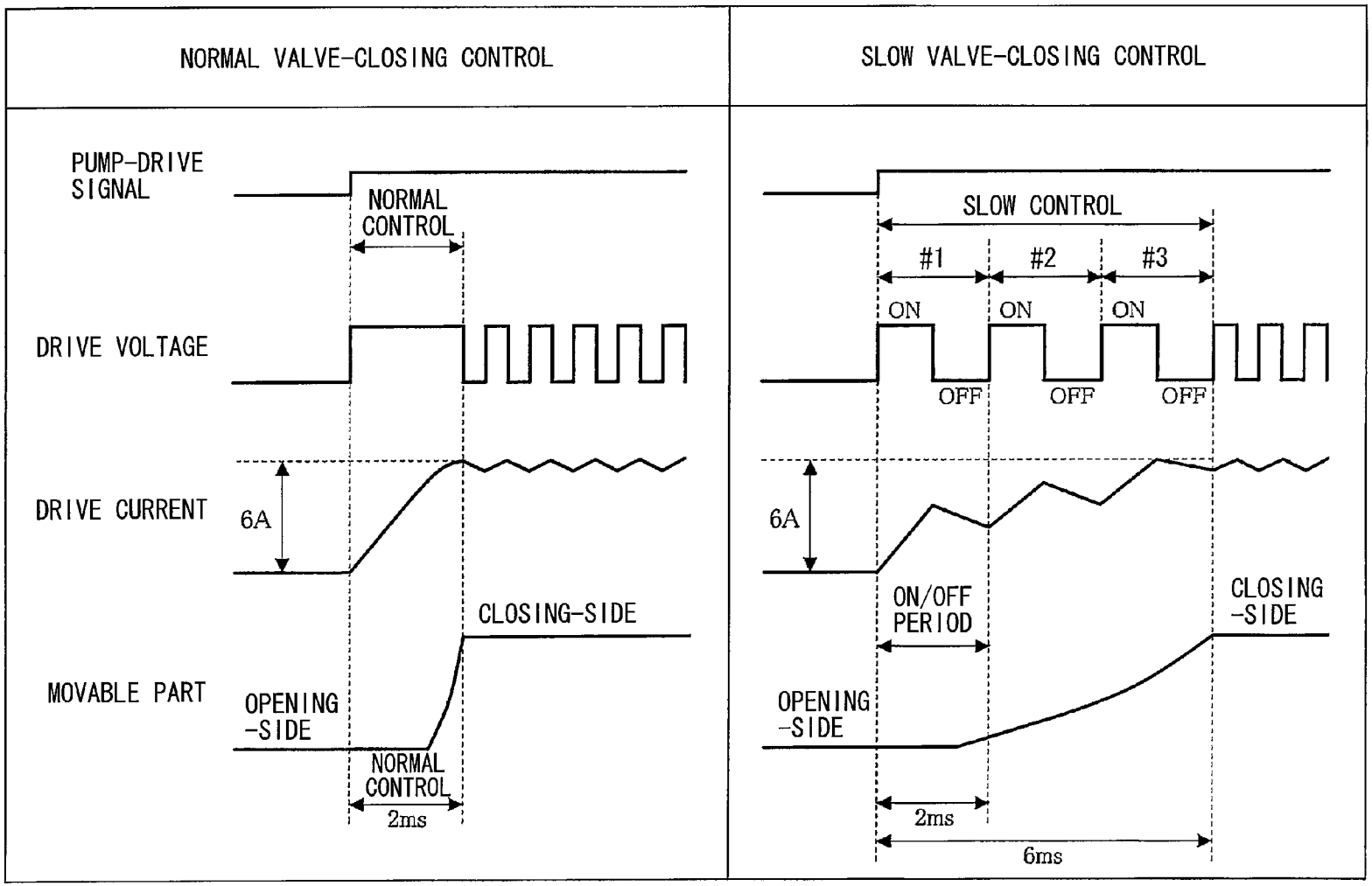
FIG. 23 is a chart to illustrate a method for setting a cycle and the number of times when a drive voltage is put on and off in a normal valve-closing control and in a slow valve-closing control.

As shown in FIG. 23, in the normal valve-closing control, the drive voltage of the solenoid 30 is continuously held in an on state until the movable part 28 is moved to the closing-side position. In this case, the time required for the movable part 28 to be moved from the opening-side position to the closing-side position is set at a normal valve closing time (for example, 2 ms).

As shown in FIG. 23, when the slow valve-closing control is performed, in order to decrease the moving speed of the movable part 28, the drive voltage needs to be put off within the normal valve closing time (in other words, the time required for the movable part 28 to be moved from the opening-side position to the closing-side position in a case where the drive voltage of the solenoid 30 is continuously held in the on state). In consideration of these circumstances, when the normal valve-closing control is performed, a on and off cycle of the drive voltage of the solenoid 30 (cycle when the drive voltage is put on and off) is set at a given cycle not more than the normal valve closing time (for example, 2 ms). In this way, the moving speed of the movable part 28 can be surely decreased.

Further, when the slow valve-closing control is performed, in order to decrease the moving speed of the movable part 28, the time required for the movable part 28 to be moved from the opening-side position to the closing-side position is elongated. Thus, in order to surely move the movable part 28 to the closing-side position, the number of times of putting on and off the drive voltage (the number of times when the drive voltage is put on and off) is set at a given number of times (for example, three times) so as to repeatedly put on and off the drive voltage until the movable part 28 is moved to the closing-side position. For example, in a case where the on and off cycle of the drive voltage is set at 2 ms and where the number of times of putting on and off the drive voltage is set at three times, a period during which the slow valve-closing control is performed (the period during which the drive voltage is repeatedly put on and off) becomes 6 ms.

The ECU 40 controls the timing of starting to pass the current through the solenoid 30 of the electromagnetic actuator 27 of the high pressure pump 14 to thereby control the period during which the flow regulating valve 23 is closed, thereby controlling the amount of discharge of the fuel of the high pressure pump 14 to control the fuel pressure (the pressure of the fuel).

Figure 24:
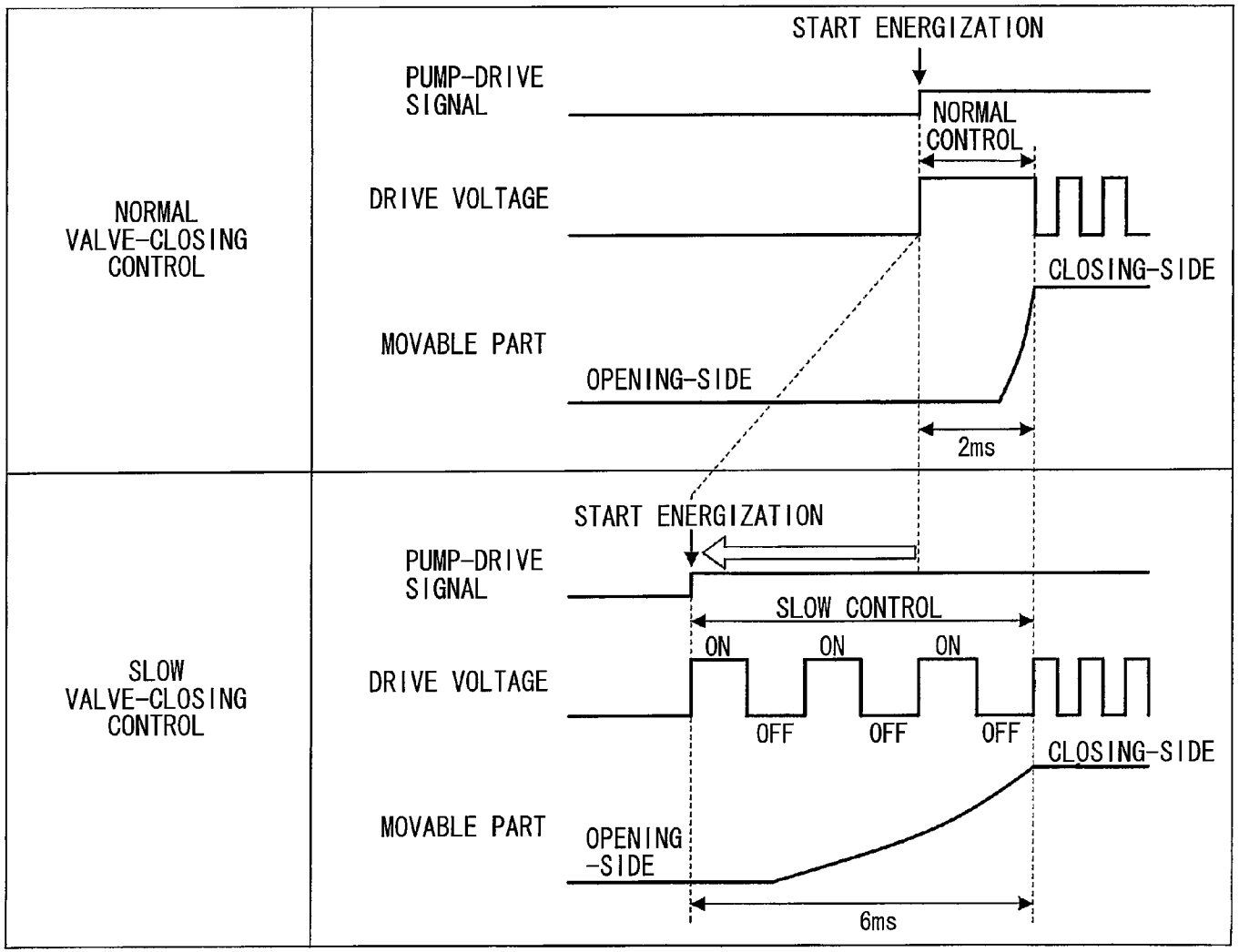
FIG. 24 is a chart to illustrate a method for switching a timing of starting to pass current through a solenoid in a normal valve-closing control and in a slow valve-closing control.

However, as shown in FIG. 24, in the slow valve-closing control, the moving speed of the movable part 28 is decreased, so that the time required for the movable part 28 to be moved from the opening-side position to the closing-side position becomes longer than in the normal valve-closing control. Thus, if the timing of starting to pass the current through the solenoid 30 in the slow valve-closing control is made equal to the timing in the normal valve-closing control, the timing when movable part 28 is moved to the closing-side position to thereby close the flow regulating valve 23 is delayed, which hence results in decreasing the amount of discharge of the fuel.

Thus, the timing of starting to pass the current through the solenoid 30 is changed between in the slow valve-closing control and in the normal valve-closing control. Specifically, when the slow valve-closing control is performed, the timing of starting to pass the current through the solenoid 30 is advanced only by an amount of elongation (for example, 4 ms) by which the time required for the movable part 28 to be moved from the opening-side position to the closing-side position is elongated in the slow valve-closing control with respect to the normal valve-closing control. In this way, in the slow valve-closing control, the timing when the flow regulating valve 23 is closed can be made equal to the timing in the normal valve-closing control and hence a decrease in the amount of discharge of the fuel can be prevented.

Figure 25:
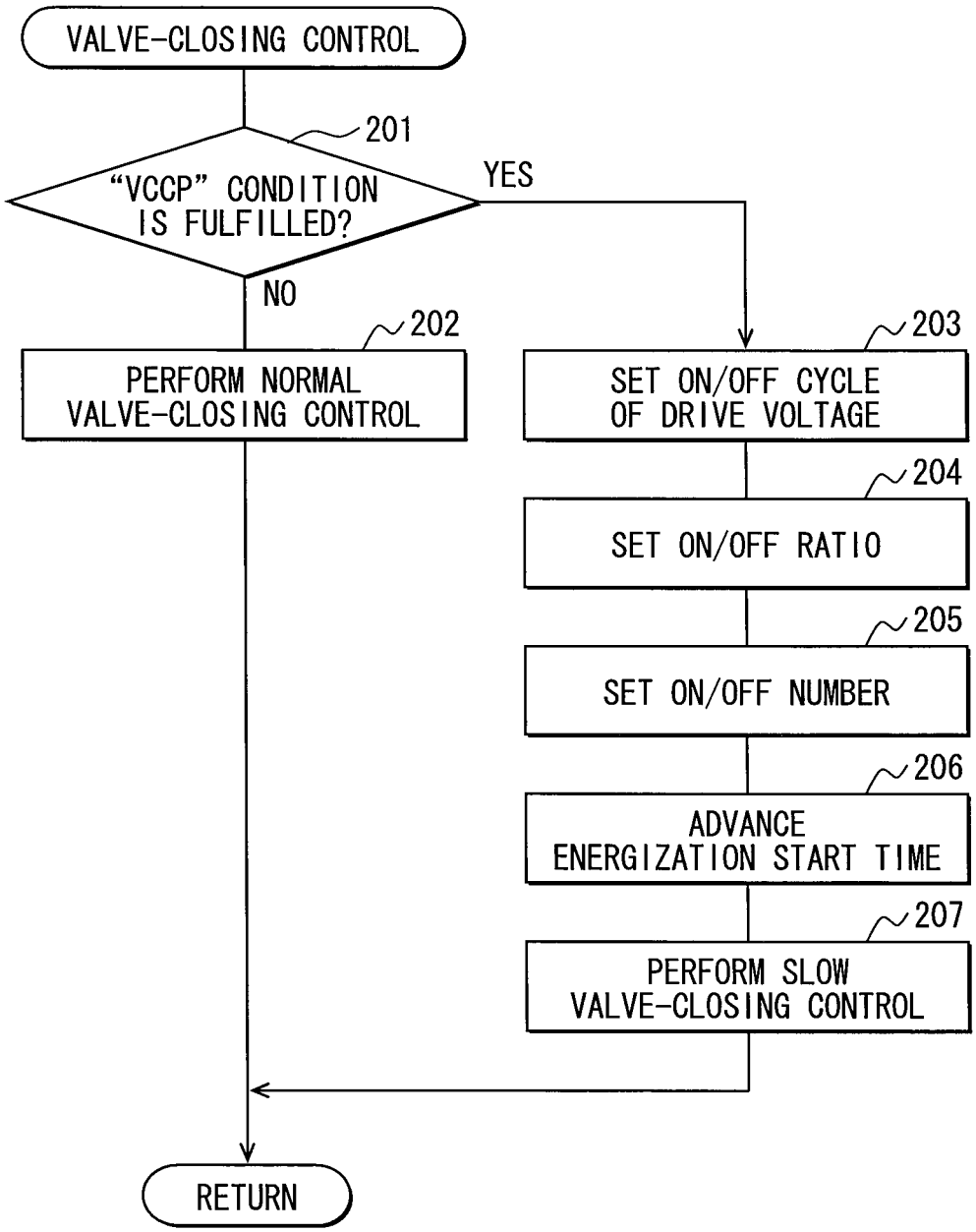
FIG. 25 is a flow chart to show a processing flow of a valve-closing control routine in the second embodiment.

The valve-closing control of the high pressure pump 14 of the present second embodiment described above is performed by the ECU 40 according to the valve-closing control routine shown in FIG. 25. Hereinafter, the processing contents of this routine will be described.

The valve-closing control routine shown in FIG. 25 is repeatedly executed at given intervals in the period during which the power of the ECU 40 is on (in the period during which an ignition switch is on), whereby the ECU 40 acts as the valve-closing control portion. When this routine is started, first, in step 201, whether or not a valve-closing control performing (VCCP) condition is fulfilled is determined by whether or not, for example, all of the following conditions (1) to (5) are satisfied.

(1) A battery voltage is in a stable state (battery voltage>given value).

(2) A vehicle is running at a low speed or is standing (vehicle speed≤given value).

(3) An accelerator is off (accelerator opening=0).

(4) An engine rotation speed is in a stable state.

(|target rotation speed−engine rotation speed|≤given value)

(5) A fuel pressure is in a stable state.

(|target fuel pressure−fuel pressure|≤given value)

The conditions of (2) and (3) are conditions used for determining whether or not noises caused when the valve-closing control is performed are in a state where the driver easily hears the noises.

If all of the conditions of (1) to (5) are satisfied, the slow valve-closing control performing condition is fulfilled, whereas if any one of the conditions of (1) to (5) is not satisfied, the slow valve-closing control performing condition is not fulfilled.

In a case where it is determined in step 201 that the slow valve-closing control performing condition is not fulfilled, the processing proceeds to step 202 where the normal valve-closing control is performed. In the normal valve-closing control, by continuously holding the drive voltage of the solenoid 30 in the on state, the drive current of the solenoid 30 is quickly increased. In this way, the electromagnetic attracting force of the solenoid 30 is quickly increased to thereby quickly move the movable part 28 to the closing-side position, thereby closing the flow regulating valve 23.

On the other hand, in a case where it is determined in step 201 that the slow valve-closing control performing condition is fulfilled, it is determined that the noises caused when the valve-closing control is performed are in the state where the driver easily hears the noises and hence the slow valve-closing control is performed in the following manner. First, in step 203, the on and off cycle of the drive voltage of the solenoid 30 is set at a given cycle (for example, 2 ms) not more than the normal valve closing time. The given cycle is set previously on the basis of test data or design data and is stored in the ROM of the ECU 40.

Then, the processing proceeds to step 204 where the on and off ratio of the drive voltage of the solenoid 30 is set at a given ratio (for example, 50%). Here, the given ratio is an on and off ratio in which the convergent current value "i" becomes a value (for example, 6 A) equal to the convergent current value of the normal valve-closing control (in a case where the driver is guarded by a given upper limit, the upper limit). This given ratio is set previously on the basis of test data or design data and is stored in the ROM of the ECU 40.

When the drive voltage of the solenoid 30 is varied, the convergent current value is varied, so that the on and off ratio is changed according to the drive voltage to thereby correct the on and off ratio of the drive voltage in such a way that the convergent current value "i" becomes equal to the convergent current value of the normal valve-closing control. Further, when the temperature of the solenoid 30 is varied, the resistance value of the solenoid is varied and hence the convergent current value is varied, so that the on and off ratio of the drive voltage is changed according to the temperature of the solenoid 30 (resistance value estimated from the temperature of the solenoid 30) to thereby correct the on and off ratio of the drive voltage in such a way that the convergent current value becomes equal to the convergent current value of the normal valve-closing control.

Then, the processing proceeds to step 205 where the number of on and off times of the drive voltage of the solenoid 30 is set at, for example, a given number of times (for example, three times). Here, the given number of times is the number of times required for the drive voltage to be repeatedly put on and off until the movable part 28 is moved to the closing-side position. The given number of times is set previously on the basis of test data or design data and is stored in the ROM of the ECU 40.

Then, the processing proceeds to step 206 where the timing of starting to pass the current through the solenoid 30 is advanced only by an amount of elongation (for example, 4 ms) by which the time required for the movable part 28 to be moved from the opening-side position to the closing-side position is elongated in the slow valve-closing control with respect to the normal valve-closing control.

Then, the processing proceeds to step 207 where the slow valve-closing control is performed. In this slow valve-closing control, the drive voltage of the solenoid 30 is repeatedly put on and off under the conditions set in steps 203 to 106 to thereby decrease the rate of rise of the drive current of the solenoid 30 more than in the normal valve-closing control. In this way, the electromagnetic attracting force of the solenoid 30 is slowly increased to thereby slowly move the movable part 28 to the closing-side position, thereby closing the flow regulating valve 23.

In the present second embodiment described above, when the valve-closing control is performed (in other words, when the drive current is passed through the solenoid 30 of the electromagnetic actuator 27 to thereby move the movable part 28 to the closing-side position, thereby closing the flow regulating valve 23), if the given slow valve-closing control performing condition is fulfilled (if there is brought about a state in which the driver easily hears the noises caused when the valve-closing control is performed), the slow valve-closing control for decreasing the rate of rise of the drive current of the solenoid 30 more than in the normal valve-closing control is performed, so that the electromagnetic attracting force of the solenoid 30 can be slowly increased to thereby decease the moving speed of the movable part 28. This can prevent vibrations caused when the movable part 28 collides with the stopper part 41 and hence can reduce noises caused when the valve-closing control is performed.

In addition, the rate of rise of the drive current of the solenoid 30 is only decreased more than in the normal valve-closing control, so that finally the drive current of the solenoid 30 can be increased to a current value equal to a current value in the normal valve-closing control. In this way, even if a minimum current value necessary for closing the valve is varied according to variations in manufacture and the usage environment (drive voltage and temperature), a shortage of current can be avoided and hence a faulty valve closing operation caused by the shortage of current can be prevented and a correction using the fuel pressure does not need to be made.

It is a condition for performing the slow valve-closing control that the engine rotation speed is the given value or less (for example, vehicle speed≤given value), so that it is possible to determine with high accuracy that the noises caused when the valve-closing control is performed is in the state where the driver can easily hear the noises and to prevent the slow valve-closing control from being performed unnecessarily.

Further, in the present second embodiment, the slow valve-closing control of repeatedly putting on or off the drive voltage of the solenoid 30 to thereby decrease the rate of rise of the drive current of the solenoid 30 more than in the normal valve-closing control, which hence eliminates the need for newly providing a circuit specifically designed for performing the slow valve-closing control and makes it possible to realize the slow valve-closing control at low cost.

In the present second embodiment, the on and off ratio of the drive voltage of the solenoid 30 is changed according to both of the drive voltage of the solenoid 30 and the temperature, but the present disclosure is not limited to this. For example, the on and off ratio of the drive voltage of the solenoid 30 may be changed according to one of the drive voltage of the solenoid 30 and the temperature. Alternatively, the on and off cycle of the drive voltage of the solenoid 30 may be changed according to both or one of the drive voltage of the solenoid 30 and the temperature, or the number of on and off times of the drive voltage of the solenoid 30 may be changed according to both or one of the drive voltage of the solenoid 30 and the temperature.

[Third Embodiment]

Next, an third embodiment of the present disclosure will be described by the use of FIG. 26 to FIG. 28. However, the descriptions of parts substantially equal to those in the second embodiment will be omitted or simplified and parts different from those in the second embodiment will be mainly described.

Figure 26:
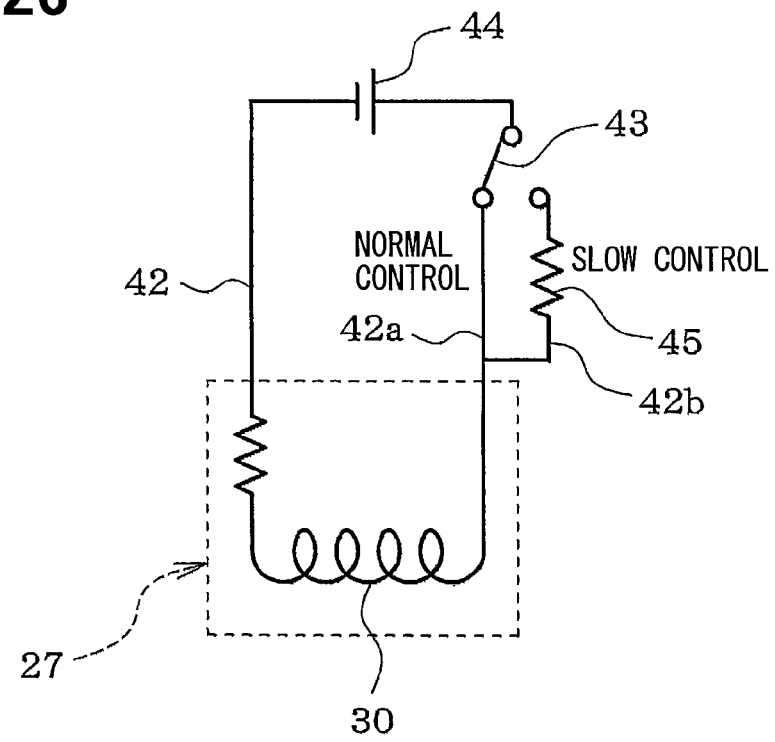
FIG. 26 is a schematic construction diagram of a current supply circuit of a solenoid of an third embodiment.
Figure 27:
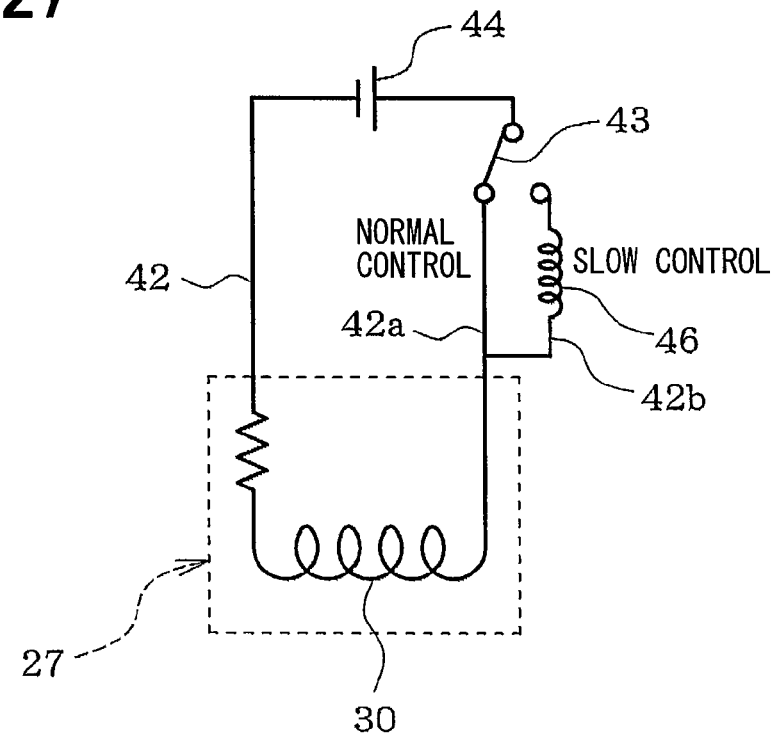
FIG. 27 is a schematic construction diagram of another current supply circuit of the solenoid of the third embodiment.

In the present third embodiment, as shown in FIG. 26, a current supply circuit 42 of the solenoid 30 is constructed in such a way that a normal circuit 42*a* of passing current through the solenoid 30 without a resistance 45 from a battery 44 and a current decreasing circuit 42*b* of passing current via the resistance 45 from the battery 44 can be switched from each other by a selector switch 43. Alternatively, as shown in FIG. 27, the current supply circuit 42 of the solenoid 30 may be constructed in such a way that a normal circuit 42*a* of passing current through the solenoid 30 without a coil 46 from the battery 44 and a current decreasing circuit 42*b* of passing current via the coil 46 from the battery 44 can be switched from each other by the selector switch 43.

In a case where the normal valve-closing control is performed, the current is passed through the solenoid 30 in a state where the current supply circuit 42 is switched to the normal circuit 42*a* (the circuit of passing the current through the solenoid 30 without the resistance 45 or the coil 46 from the battery 44) by the selector switch 43 to thereby quickly increase the drive current of the solenoid 30.

On the other hand, in a case where the slow valve-closing control is performed, the current is passed through the solenoid 30 in a state where the current supply circuit 42 is switched to the current decreasing circuit 42*b* (the circuit of passing the current through the solenoid 30 via the resistance 45 or the coil 46 from the battery 44) by the selector switch 43 to thereby decrease the rate of rise of the drive current of the solenoid 30 more than in the normal valve-closing control.

Figure 28:
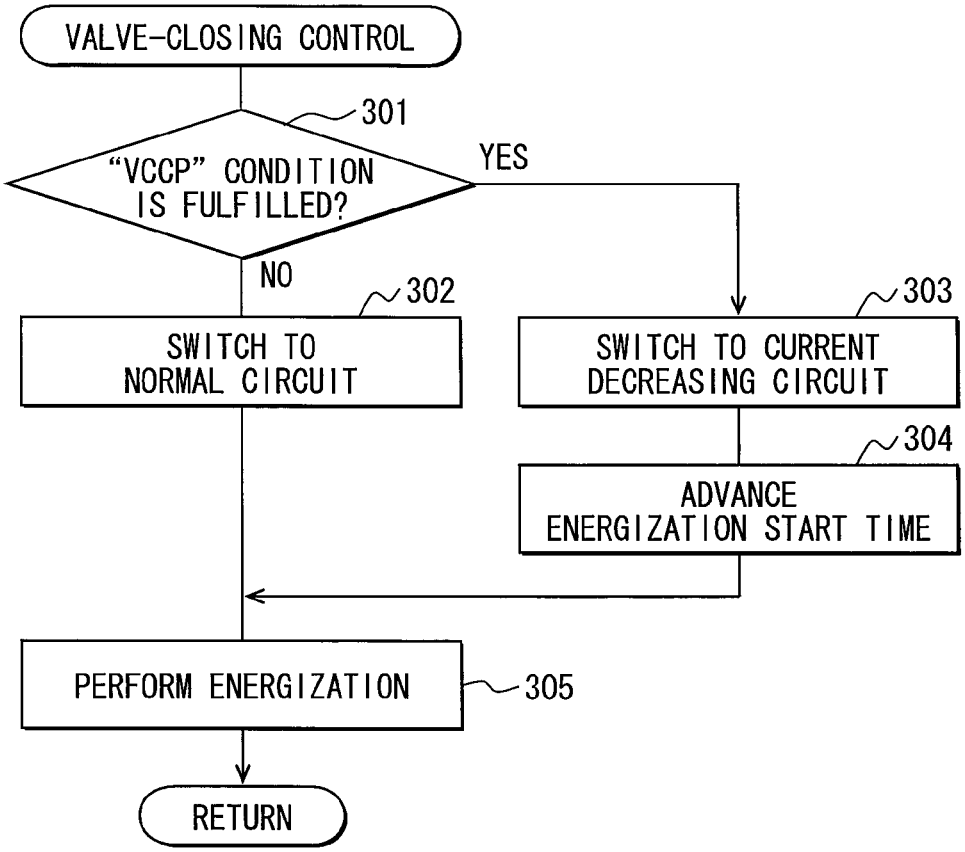
FIG. 28 is a flow chart to show a processing flow of a valve-closing control routine in the third embodiment.

The valve-closing control of the high pressure pump 14 of the present third embodiment is performed by the ECU 40 according to the valve-closing control routine shown in FIG. 28.

In the valve-closing control routine shown in FIG. 28, first, in step 301, it is determined whether or not the same slow valve-closing control performing (VCCP) condition as in the step 201 shown in FIG. 25 is fulfilled.

In a case where it is determined in this step 301 that the slow valve-closing control performing condition is not fulfilled, the processing proceeds to step 302 where the current supply circuit 42 is switched to the normal circuit 42*a* (the circuit of passing the current through the solenoid 30 without the resistance 45 or the coil 46 from the battery 44) by the selector switch 43.

Then, the processing proceeds to step 305 where the current is passed through the solenoid 30 to thereby perform the normal valve-closing control of quickly increasing the drive current of the solenoid 30. In this way, the electromagnetic attracting force of the solenoid 30 is quickly increased to thereby quickly move the movable part 28 to the closing-side position, thereby closing the slow regulating valve 23.

On the other hand, in a case where it is determined in step 301 that the slow valve-closing control performing condition is fulfilled, the processing proceeds to step 303 where the current supply circuit 42 is switched to the current decreasing circuit 42*b* (the circuit of passing the current through the solenoid 30 via the resistance 45 or the coil 46 from the battery 44) by the selector switch 43. Then, the processing proceeds to step 304 where the timing of starting to pass the current through the solenoid 30 is advanced only by an amount of elongation by which the time required for the movable part 28 to be moved from the opening-side position to the closing-side position is elongated in the slow valve-closing control with respect to the normal valve-closing control.

Then, the processing proceeds to step 305 where the current is passed through the solenoid 30 to thereby perform the slow valve-closing control of decreasing the rate of rise of the drive current of the solenoid 30 more than in the normal valve-closing control. In this way, the electromagnetic attracting force of the solenoid 30 is slowly increased to thereby move the movable part 28 to the closing-side position, thereby closing the flow regulating valve 23.

In the present third embodiment described above, the current is passed through the solenoid 30 in a state where the current supply circuit 42 of the solenoid 30 is switched to the current decreasing circuit 42*b* (the circuit of passing the current through the solenoid 30 via the resistance 45 or the coils 46 from the battery 44) to thereby perform the slow valve-closing control of decreasing the rate of rise of the drive current of the solenoid 30 more than in the normal valve-closing control. Thus, the slow valve-closing control can be realized by a simple method of switching the current supply circuit 42 of the solenoid 30.

Figure 29:
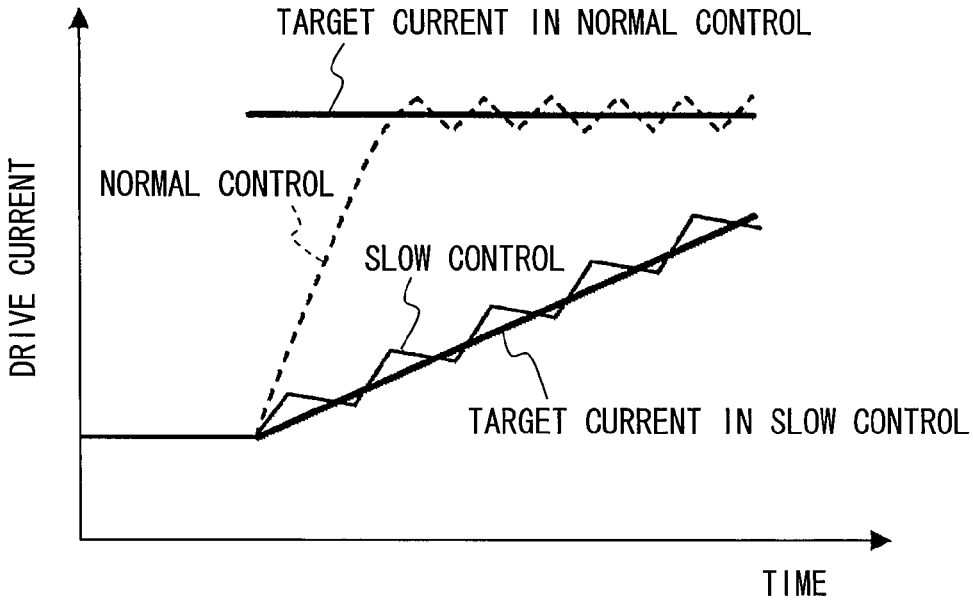
FIG. 29 is a chart to illustrate a slow valve-closing control of an fourth embodiment.

In this regard, a method of realizing the slow valve-closing control is not limited to the respective methods described above but may be modified as required. For example, like an fourth embodiment shown in FIG. 29, the slow valve-closing control may be performed by: providing a circuit capable of controlling the drive current of the solenoid 30; setting a target current of the slow valve-closing control in which the rate of rise (rising speed) of current is decreased more than a target current of the normal valve-closing control; and controlling the drive current of the solenoid 30 to the target current of the slow valve-closing control to thereby decrease the rate of rise of the drive current of the solenoid 30. Also in a case when this slow valve-closing control is performed, the timing of starting to pass the current through the solenoid 30 is advanced only by an amount of elongation by which the time required for the movable part 28 to be moved from the opening-side position to the closing-side position is elongated in the slow valve-closing control with respect to the normal valve-closing control.

In addition, the present disclosure can be variously modified within a scope not departing from the gist of the present disclosure: for example, the construction of the high pressure pump and the construction of the fuel supply system can be modified as required.

What is claimed is:

1. A control device of a high pressure pump including a pump chamber having an intake port and a discharge port of fuel, a plunger reciprocating in the pump chamber, and a flow regulating valve for opening and closing the intake port, and an electromagnetic actuator for moving the flow regulating valve to thereby open and close the flow regulating valve, the control device comprising:

a valve-opening control portion for stopping passing current through a solenoid of the electromagnetic actuator to thereby perform a valve-opening control of moving a movable part of the electromagnetic actuator from a closing-side position to an opening-side position and opening the flow regulating valve, wherein when the valve-opening control portion performs the valve-opening control, the valve-opening control portion continuously passes the current through the solenoid to thereby hold the movable part at the closing-side position until a fuel pressure in the pump chamber is decreased and the flow regulating valve is brought into a full-opened position, and after the flow regulating valve is brought into the full-opened position, the valve-opening control portion once stops passing the current through the solenoid and again temporarily passes the current through the solenoid before the movable part reaches the opening-side position.

2. A control device of a high pressure pump according to claim 1, wherein the valve-opening control portion changes a period during which the movable part is held at the closing-side position according to the fuel pressure.

3. A control device of a high pressure pump according to claim 1, wherein the valve-opening control portion changes a period during which the movable part is held at the closing-side position according to a fuel temperature.

4. A control device of a high pressure pump according to claim 1, wherein the valve-opening control portion changes a period during which the movable part is held at the closing-side position according to a rotation speed of a cam for driving the plunger.

5. A control device of a high pressure pump according to claim 1, wherein the valve-opening control portion changes a period during which the movable part is held at the closing-side position according to a profile of a cam for driving the plunger.

6. A control device of a high pressure pump according to claim 1, wherein the valve-opening control portion sets a current value when the valve-opening control portion again temporarily passes the current through the solenoid before the movable part reaches the opening-side position at a value within a range in which the movable part is not moved back in the direction of the closing-side position.

7. A control device of a high pressure pump according to claim 1, wherein the valve-opening control portion performs a flyback control of removing a current, which flows through the solenoid when the valve-opening control portion once stops passing the current through the solenoid after the flow regulating valve is brought into the full-opened position, by a flyback circuit.

* * * * *